US011016407B2

(12) United States Patent
Furuta

(10) Patent No.: US 11,016,407 B2
(45) Date of Patent: May 25, 2021

(54) IMAGE FORMING APPARATUS

(71) Applicant: CANON KABUSHIKI KAISHA, Tokyo (JP)

(72) Inventor: Yasutomo Furuta, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/678,285

(22) Filed: Nov. 8, 2019

(65) Prior Publication Data

US 2020/0150554 A1 May 14, 2020

(30) Foreign Application Priority Data

Nov. 9, 2018 (JP) ..... JP2018-211159

(51) Int. Cl.
*G03G 15/043* (2006.01)

(52) U.S. Cl.
CPC ..... *G03G 15/043* (2013.01)

(58) Field of Classification Search
CPC ..... G03G 15/043; B41J 2/447–46
See application file for complete search history.

(56) References Cited

U.S. PATENT DOCUMENTS

2001/0048318 A1* 12/2001 Matsueda ..... G09G 3/3648 324/750.3
2010/0157011 A1* 6/2010 Ohno ..... B41J 2/451 347/224
2011/0164103 A1* 7/2011 Kii ..... G03G 15/326 347/118
2011/0285805 A1* 11/2011 Nagumo ..... G03G 15/04036 347/247
2012/0249716 A1* 10/2012 Nagumo ..... G06K 15/1894 347/224
2012/0251181 A1* 10/2012 Nagumo ..... G03G 15/04054 399/177
2014/0023399 A1* 1/2014 Ohno ..... H05B 47/10 399/220
2016/0018755 A1* 1/2016 Obayashi ..... G03G 15/04054 347/118
2019/0384205 A1 12/2019 Furuta

FOREIGN PATENT DOCUMENTS

JP 07-156444 A 6/1995

* cited by examiner

*Primary Examiner* — Carla J Therrien
(74) *Attorney, Agent, or Firm* — Venable LLP

(57) ABSTRACT

An exposure head includes surface emitting element array chips and a driving voltage generation portion outputting a driving voltage to the surface emitting element array chip. The driving voltage generation portion includes digital analog conversion control circuits (DACs) provided corresponding to each surface light emitting element array chip and output drive voltages, and DACs which output maximum and minimum drive voltages. A CPU controls the DACs and outputs a driving voltage corresponding to the light emission amount of each surface light emitting element array chip.

5 Claims, 14 Drawing Sheets

(b)

(a)

(a)

(b)

(a)

(b)

(a)

(b)

IMAGE FORMING APPARATUS

FIELD OF THE INVENTION AND RELATED ART

The present invention relates to an electrophotographic image forming apparatus.

In a printer which is an electrophotographic image forming apparatus, a method of exposing a photosensitive drum using an exposure head to form a latent image is generally known. Here, a LED (Light Emitting Diode) or an organic EL (Organic Electro Luminescence) device is used for the exposure head. The exposure head comprises a light emitting element array arranged in the longitudinal direction of the photosensitive drum, and a rod lens array which forms an image of light from the light emitting element array, on the photosensitive drum. LEDs and organic ELs having a surface-emitting shape in which the direction of light emitted from the light-emitting surface is the same as that of the rod lens array is known. Here, the length of the light emitting element array is determined depending on the width of the image area on the photosensitive drum, and the interval between the light emitting elements is determined according to the resolution of the printer. For example, in the case of a 1200 dpi printer, the pixel spacing is 21.16 and therefore, the spacing between the adjacent light emitting elements is also the spacing corresponding to 21.16 μm. In the case of an image forming device capable of printing on an A3 size recording sheet (approximately 300 mm in the short side direction) with these spaces between the adjacent light emitting elements, 14173 (=300 mm×(1200 dpi/25.4 cm/in)) light emitting elements are arranged. In the case of mounting discrete light-emitting elements on a printed circuit board by wire bonding, if the number of light-emitting elements is large, the number of wire bonding positions increases, and therefore, the mounting cost increases. Therefore, conventionally, a method of reducing the number of wire bandings by forming a plurality of light emitting element arrays on one semiconductor chip and sharing the terminals for the surface light emitting elements within the semiconductor chip has been used. For example, when 500 light emitting elements are formed on one semiconductor chip, and 29 semiconductor chips (≈14173/500) are enough on the printed circuit board to cover the image area width of 300 mm to be capable of printing on an A3 size recording sheet. By this, the number of discrete light emitting elements mounted (number of wire bondings) can be significantly reduced. Printers which use such an exposure head, as compared to laser scanning printers which scan a photosensitive drum with a laser beam deflected by a rotating polygonal mirror, use a smaller number of parts, and therefore, downsizing of equipment and cost reduction are easy. In addition, in a printer using an exposure head, the sound generated by the rotation of the rotary polygonal mirror is eliminated.

On the other hand, the semiconductor chips are known to have individual differences in the intensity of light due to manufacturing variations. When a plurality of light emitting element arrays are arranged on one semiconductor chip, as described in the foregoing, density unevenness becomes visually recognized due to individual differences in the intensity of light when the width of the semiconductor chip is a visible width (for example, 1 mm or more). Japanese Patent Application Laid-Open No. H07-156444, for example, proposes a method of adjusting the light intensity in which the image density is made uniform by providing an adjusting means for adjusting the light intensity for each semiconductor chip.

SUMMARY OF THE INVENTION

Problems to be Solved by the Invention

However, when the light intensity adjusting means is provided for individual semiconductor chips as described above, there is a problem that the circuit scale of the light quantity adjusting means is large, resulting in an increase in cost. For example, using a DAC (digital analog conversion control circuit) to control the drive voltage or drive current of the light emitting element, and to suppress the variation in the intensity of light of the semiconductor chip in the exposure head to within 1%, a DAC with a resolution of 7 bits (128 steps from 0 to 127) or higher is required. On the other hand, even if a 7-bit DAC is used, if the light quantity of the entire exposure head is changed dynamically in the image forming apparatus, the control resolution of the light quantity may be insufficient. In an image forming apparatus, the intensity of light required to provide a predetermined density changes due to variations in the photosensitive drum and toner and temperature changes. Therefore, in many image forming apparatuses, the image density is detected by a density sensor provided in the image forming apparatus, and the light intensity of the exposure head is adjusted so as to provide the predetermined density. Here, Pmax is the required light intensity when the highest light intensity is required during image formation, and Pmin the required light intensity when the lowest light intensity is required. For example, if the total light intensity is controlled dynamically so that the light intensity Pmin is 20% of the light intensity Pmax, the DAC value of the light intensity Pmin is approximately 25 (=127×0.2 (20%)). When correcting the light intensity difference for each chip in the exposure head when the light intensity is Pmin, the control resolution of the light intensity is 4% (the percentage of DAC value 24 or 26 when the DAC value is increased or decreased by one step to the DAC value 25 is ±4%), and the control resolution is coarse. Therefore, even when the intensity of light is Pmin, in order to keep the control resolution within 1%, four times the resolution is required, and a 9-bit (=7 bits+2 bits) DAC is required. As described in the foregoing, since each semiconductor chip requires a light intensity adjustment function, the same number of bit resolution as the number of the semiconductor chips (i.e., 9) is required, with the result of increasing the circuit scale.

The present invention has been made under such circumstances, and an object of the present invention is to suppress an increase in circuit scale and to control the variation in the intensity of light for each semiconductor chip with high accuracy.

Means for Solving the Problem

According to an aspect of the present invention, there is provided an image forming apparatus comprising a photosensitive drum; a print head including a plurality of light emitting elements for exposing said photosensitive drum; an image formation controller configured to control said print head to form an image in accordance with image data; said print head including a plurality of array chips each including a plurality of light emitting elements, and an output portion configured to output a driving voltage for driving said light emitting element to said array chips, said output portion including a first voltage controller provided corresponding to each of said array chips and configured to output the drive voltage, a second voltage controller configured to output a maximum voltage of the drive voltages outputted to each of said array chips to said first voltage controller, and a third voltage controller configured to output a minimum voltage of the drive voltages outputted to each of said chips to said first voltage controller, said first voltage controller including a resistance portion including a plurality of resistors, and a switch which is provided corresponding to each of said plurality of resistors and which is turned on or off in accordance with an instruction from said image forming controller to divide the input voltage by said resistance portion, wherein said image formation controller controls said switch in accordance with the image data so that said output portion outputs, to each of said plurality of array chips, a voltage between the maximum voltage and the minimum voltage on the basis of the maximum voltage outputted from said second voltage controller and the minimum voltage outputted from said third voltage controller.

According to another aspect of the present invention, there is provided an image forming apparatus comprising a photosensitive drum; a print head including a plurality of light emitting elements for exposing said photosensitive drum; an image formation controller configured to control said print head to form an image in accordance with image data; said print head including a plurality of array chips each including a plurality of light emitting elements, and an output portion configured to output a driving voltage for driving said light emitting element to said array chips, said output portion including a first voltage controller provided corresponding to each of said array chips and configured to output the drive voltage, a second voltage controller configured to output a maximum voltage of the drive voltages outputted to each of said array chips to said first voltage controller, and a third voltage controller configured to output a minimum voltage of the drive voltages outputted to each of said chips to said first voltage controller, said first voltage controller including a switch portion configured to be turned on or off in response to a control signal from said image formation controller, wherein when it is on, the maximum voltage inputted from said second voltage controller is outputted, and when it is off, the minimum voltage inputted from said third voltage controller is outputted, and a smoothing portion configured to smooth the voltage outputted from said switch portion and output the smoothed voltage to said array chip.

Further features of the present invention will become apparent from the following description of exemplary embodiments with reference to the appended drawings.

Figure 2:
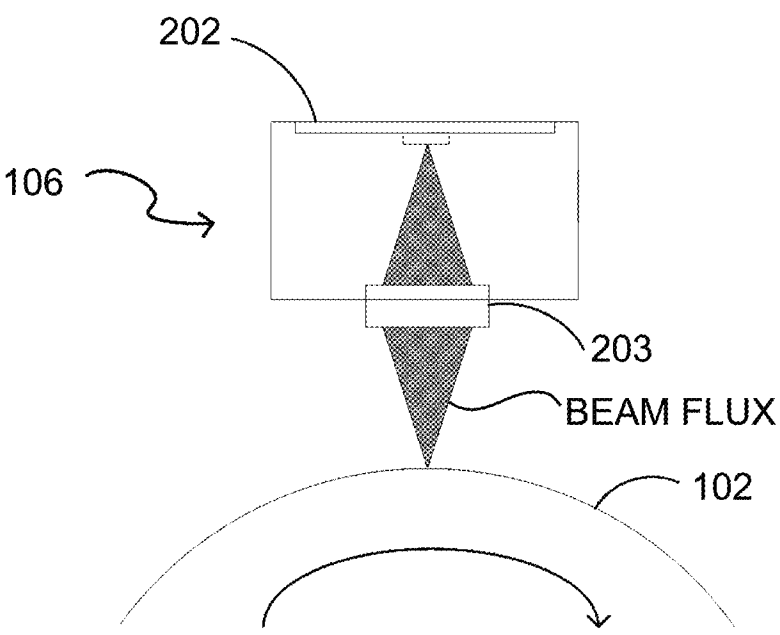
Figure 2:
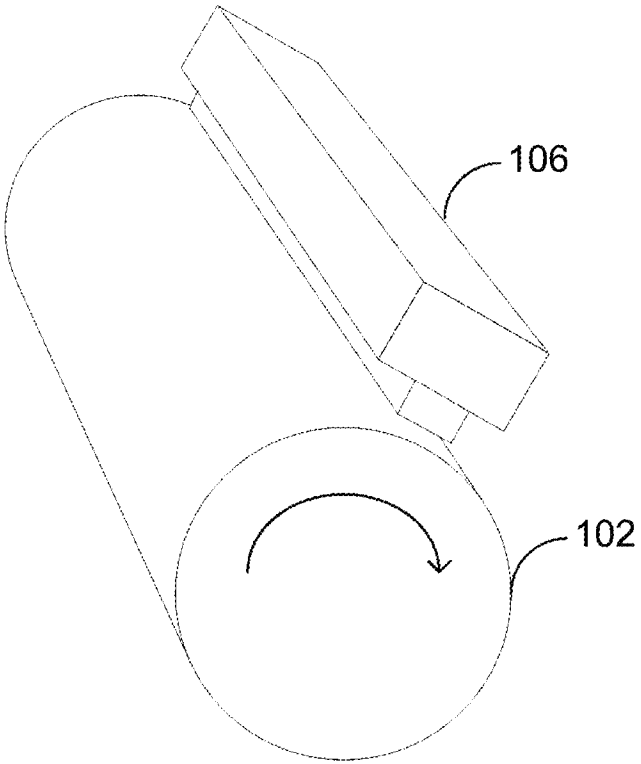

Parts (a) and (b) of FIG. 2 are views illustrating a positional relationship between an exposure head and a photosensitive drum in the embodiment, and a view illustrating a structure of the exposure head, respectively.

Figure 3:
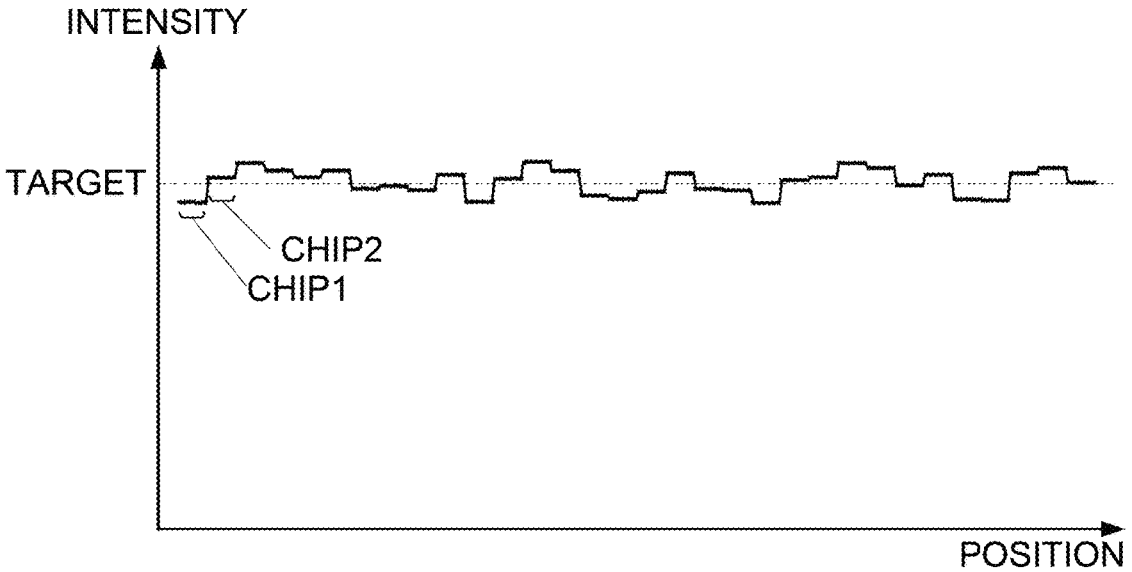
Figure 3:
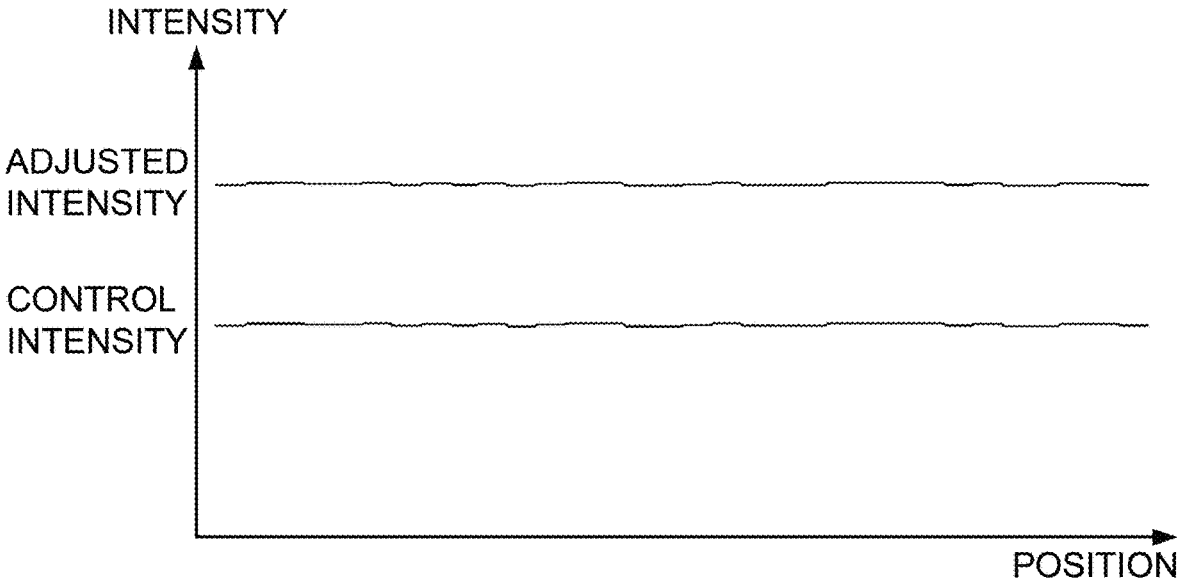

Parts (a) and (b) of FIG. 3 are views illustrating the intensity of emitted light before and after adjustment of the entire exposure head in the embodiment, respectively.

Figure 4:
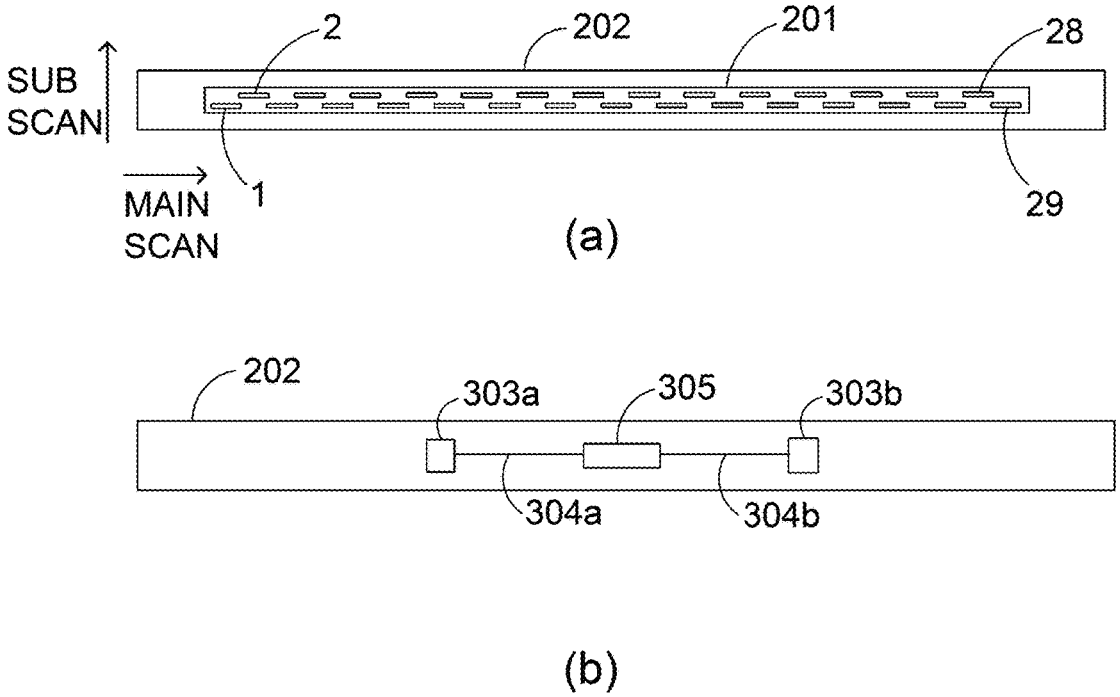
Figure 4:
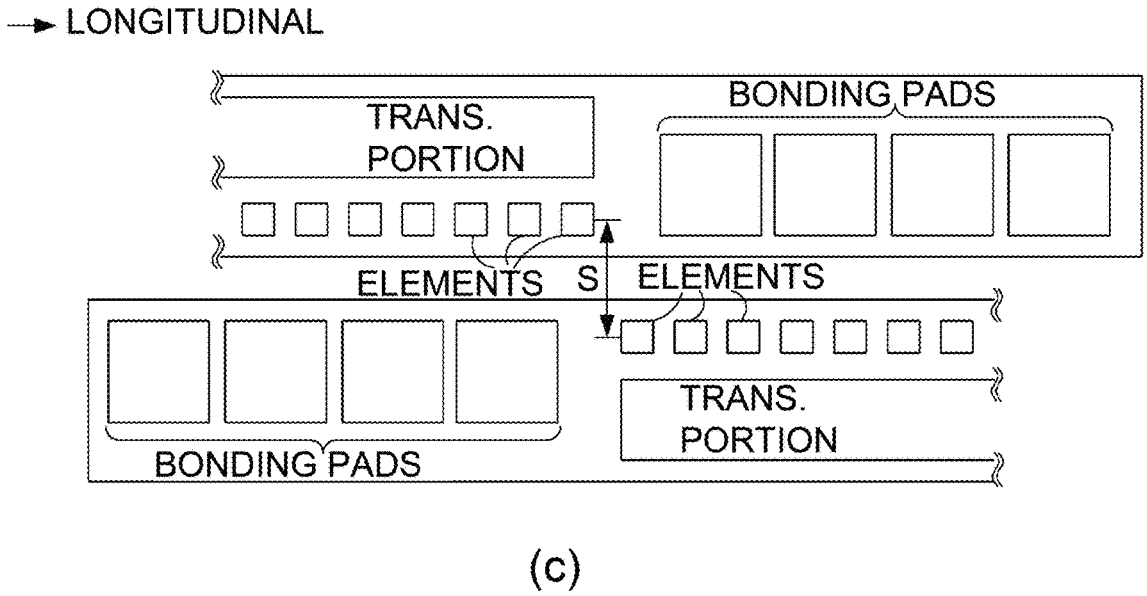

Parts (a), (b) and (c) of FIG. 4 are schematic illustrations of a driving substrate in the embodiment, and an illustration of a structure of a surface light emitting element array chip.

Figure 5:
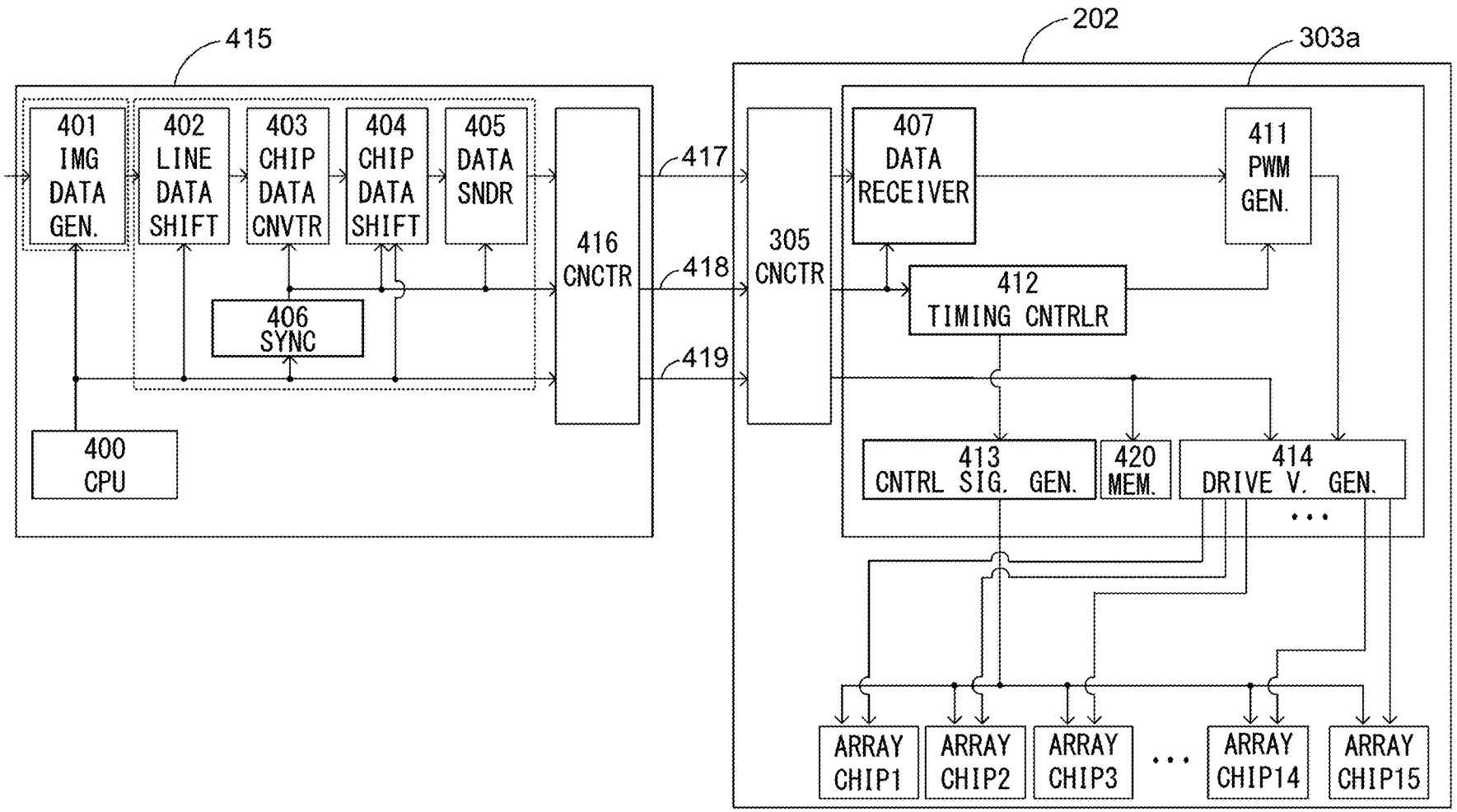

FIG. 5 is a control block diagram of a control board and the exposure head in the embodiment.

Figure 6:
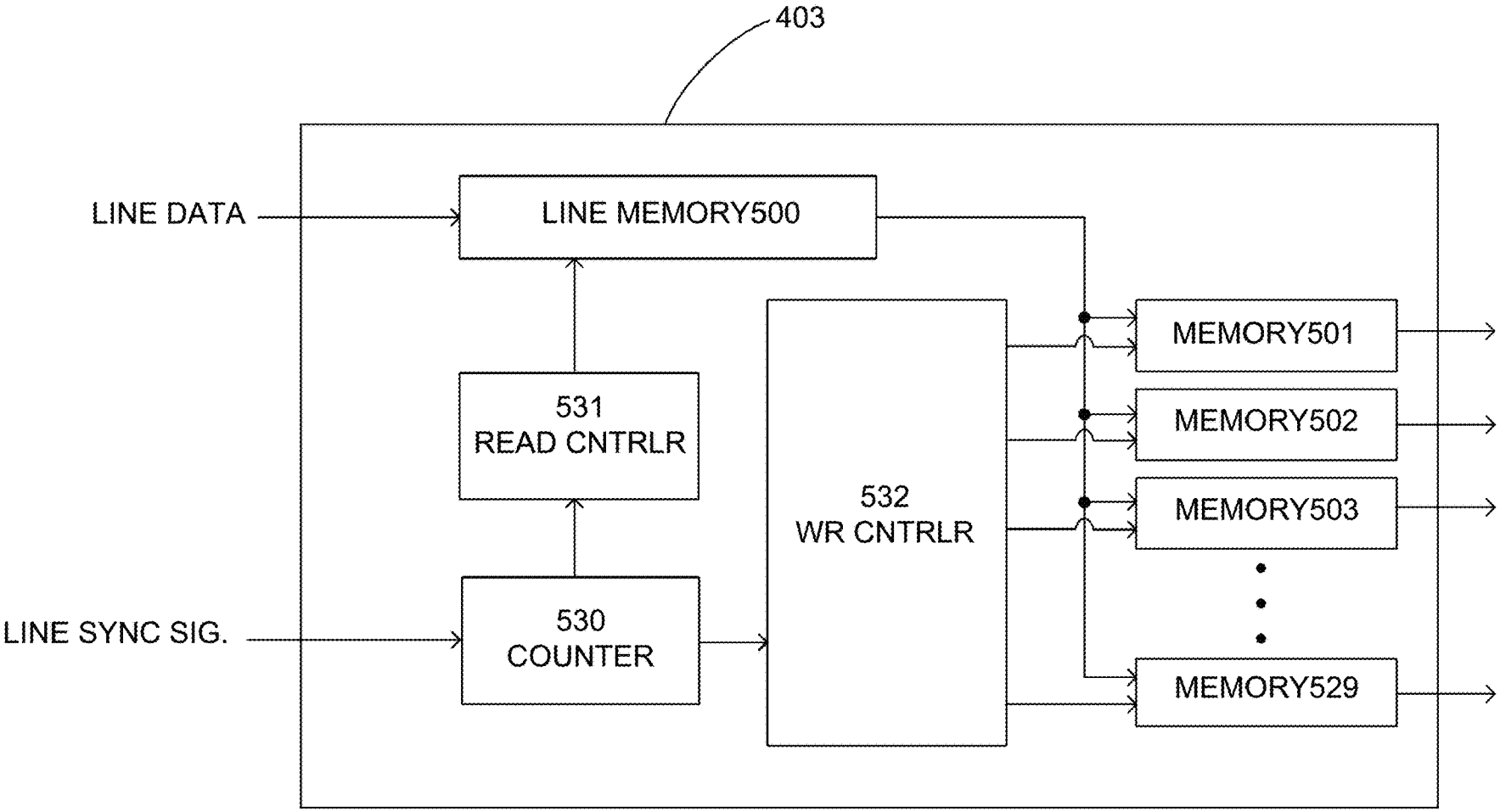

FIG. 6 is a control block diagram of a chip data converter in the embodiment.

Figure 7:
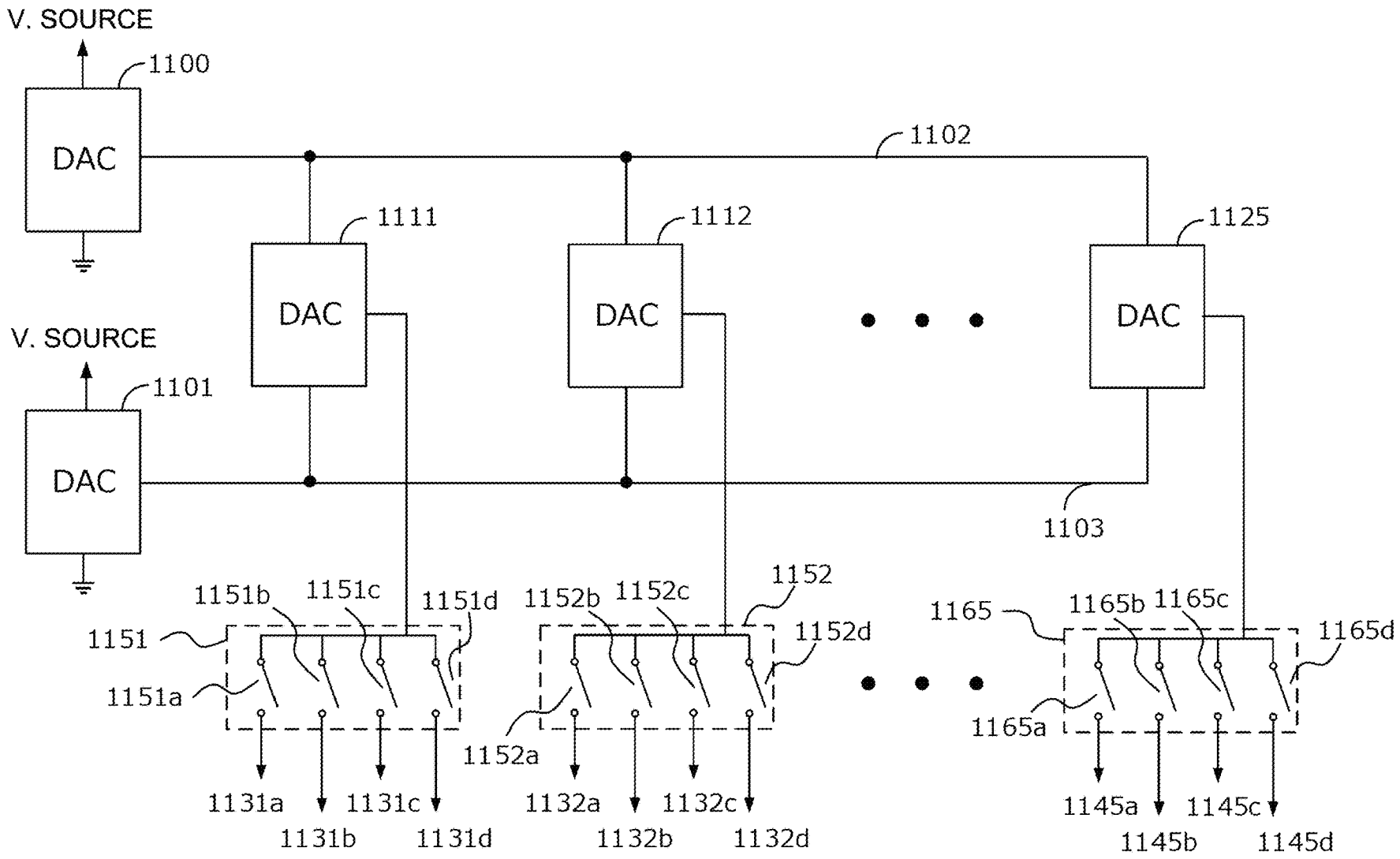

FIG. 7 is a schematic illustration showing a circuit structure of a drive voltage generation portion in the embodiment.

Figure 8:
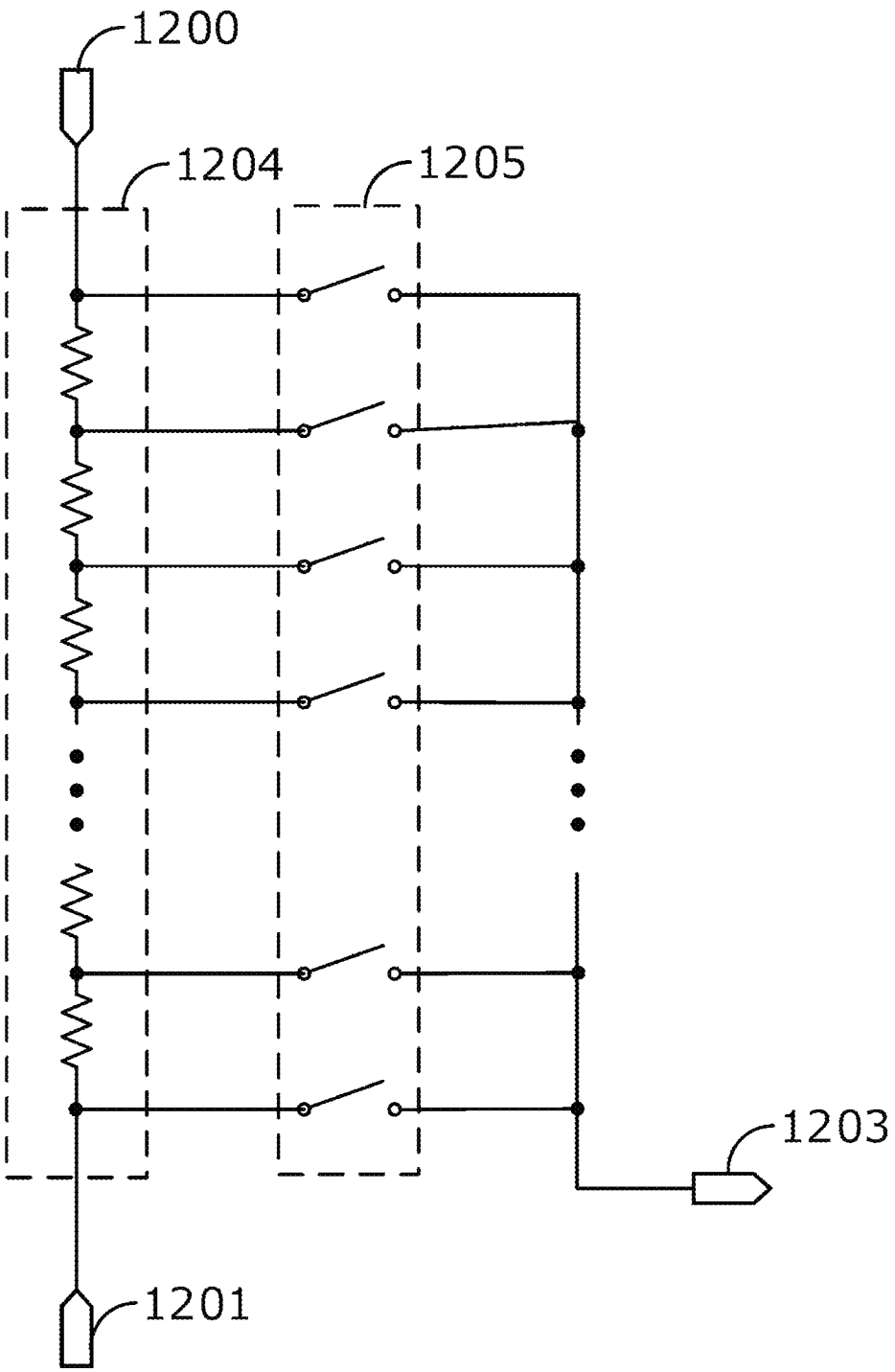

FIG. 8 is a schematic illustration showing a circuit structure of a DAC in the embodiment.

Figure 9:
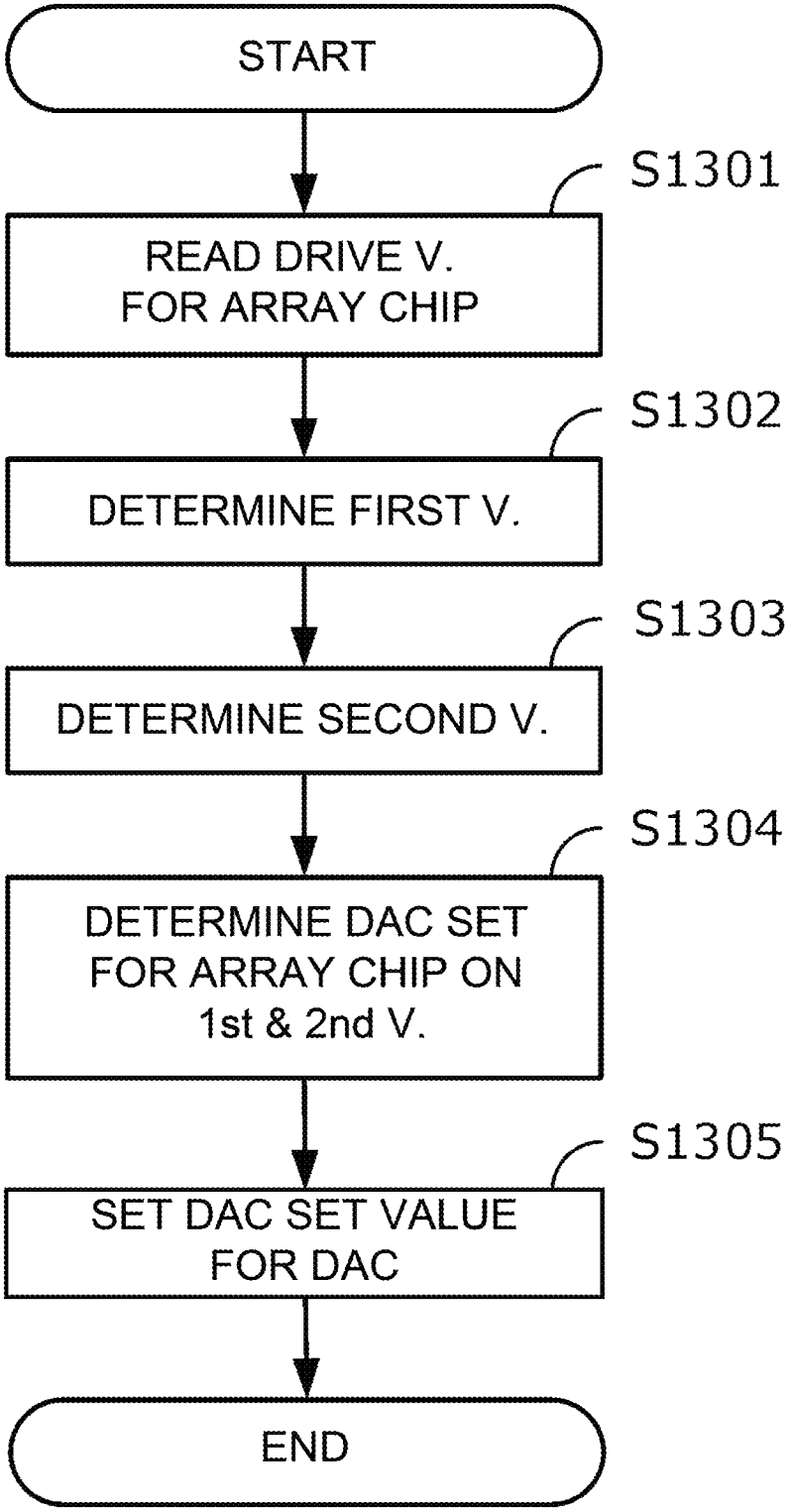

FIG. 9 is a flowchart showing a control sequence for determining an output voltage of the DAC in the embodiment.

Figure 10:
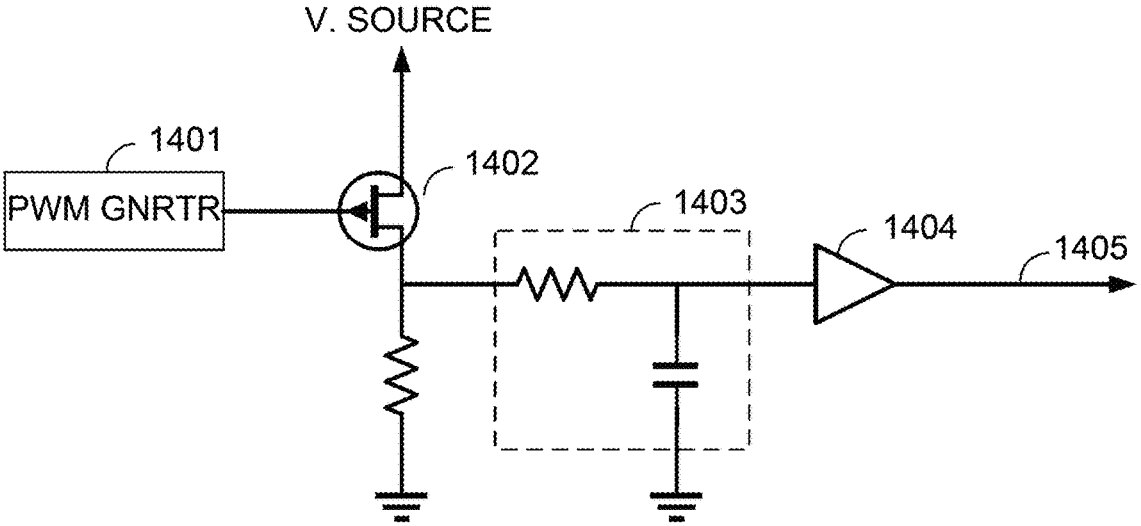
Figure 10:
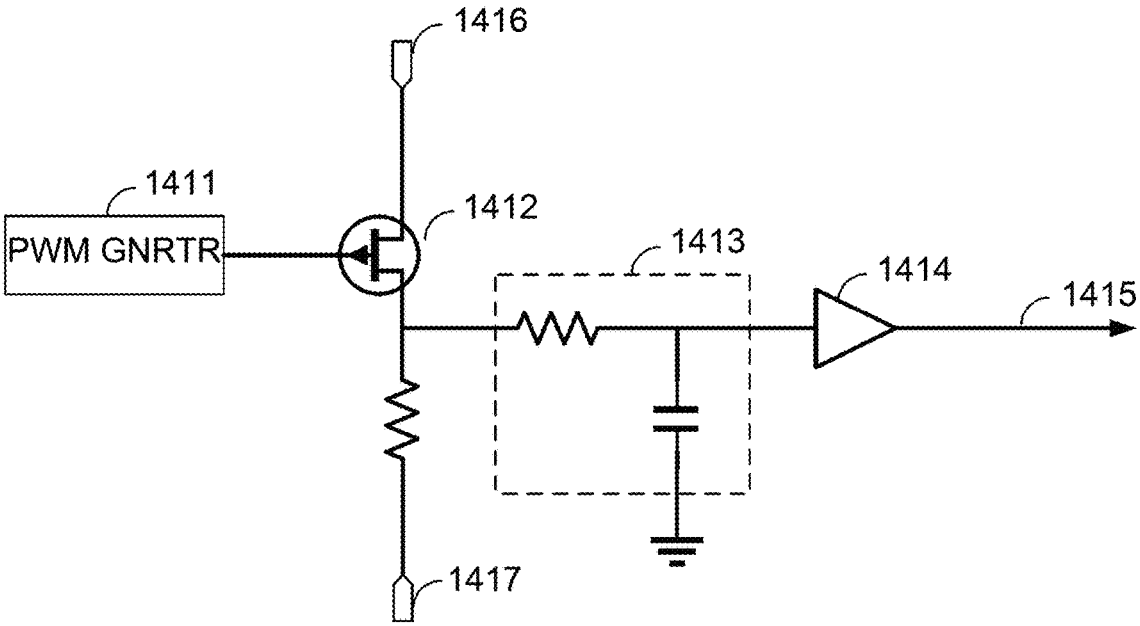

Parts (a) and (b) of FIG. 10 are schematic illustrations of a circuit structure of the DAC in the embodiment.

Figure 11:
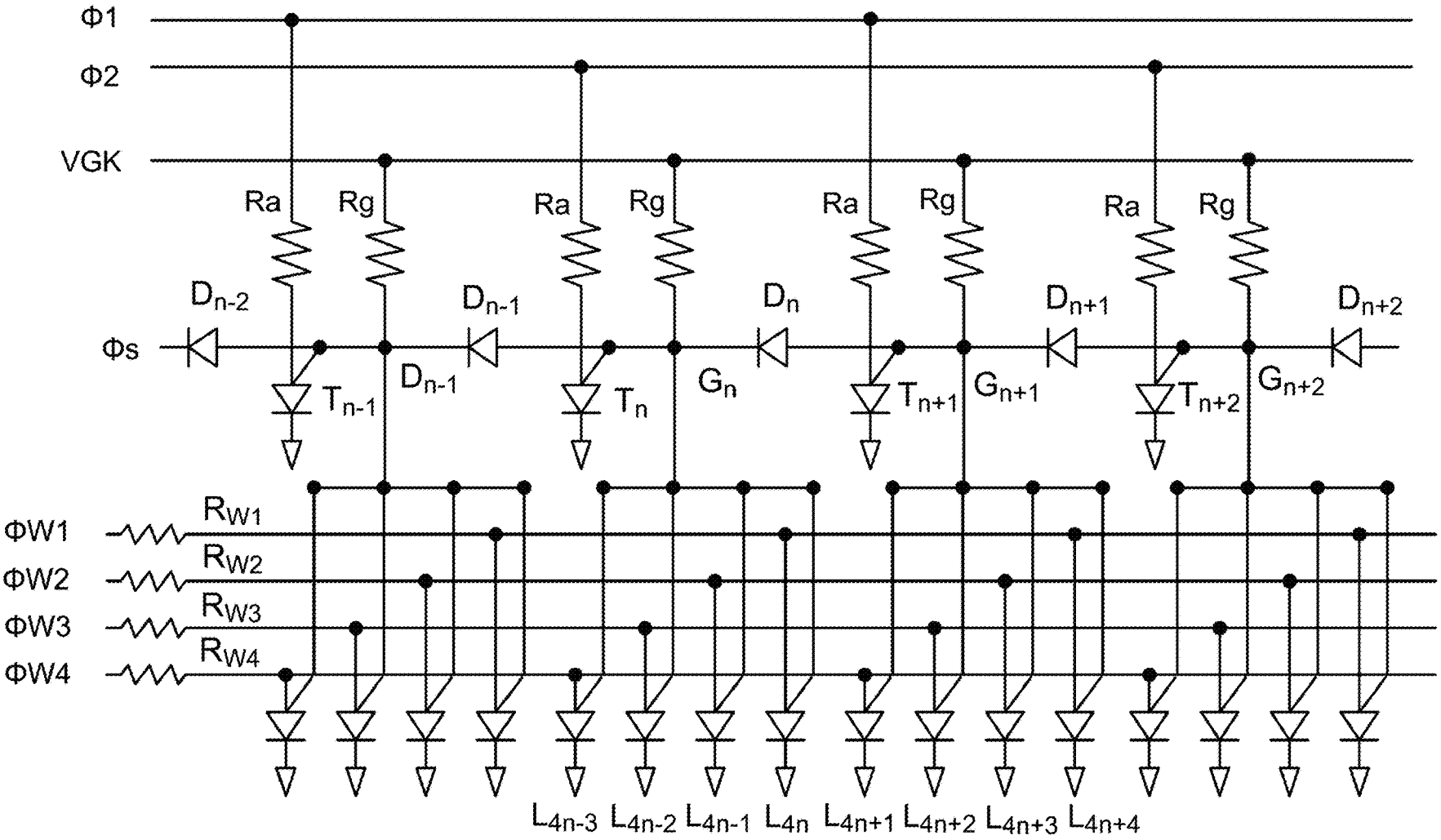

FIG. 11 is a view illustrating a circuit of a surface emitting element array chip in the embodiment.

Figure 12:
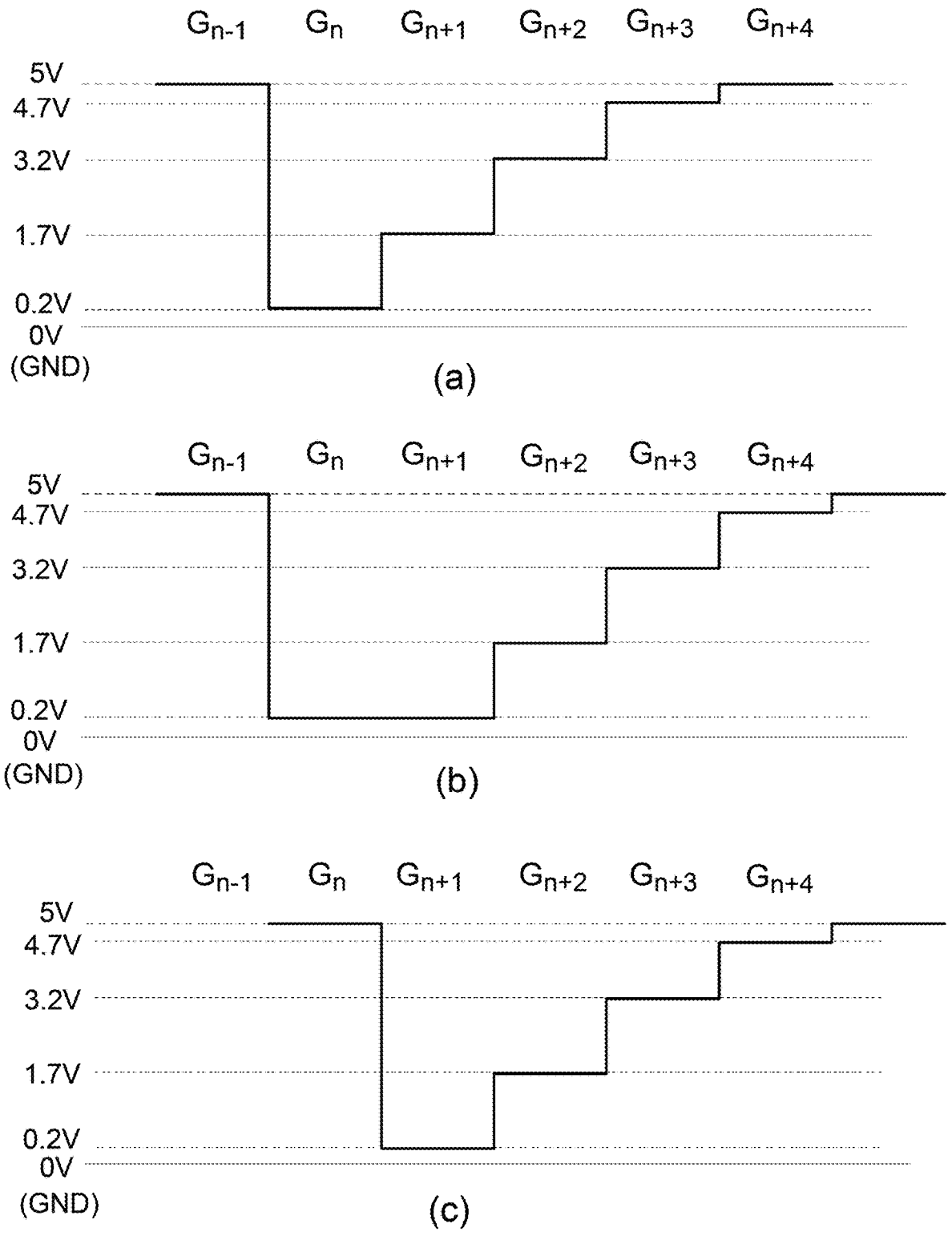

Parts (a), (b) and (c) of FIG. 12 are views illustrating a distribution state of a gate potential of a shift thyristor in the embodiment.

Figure 13:
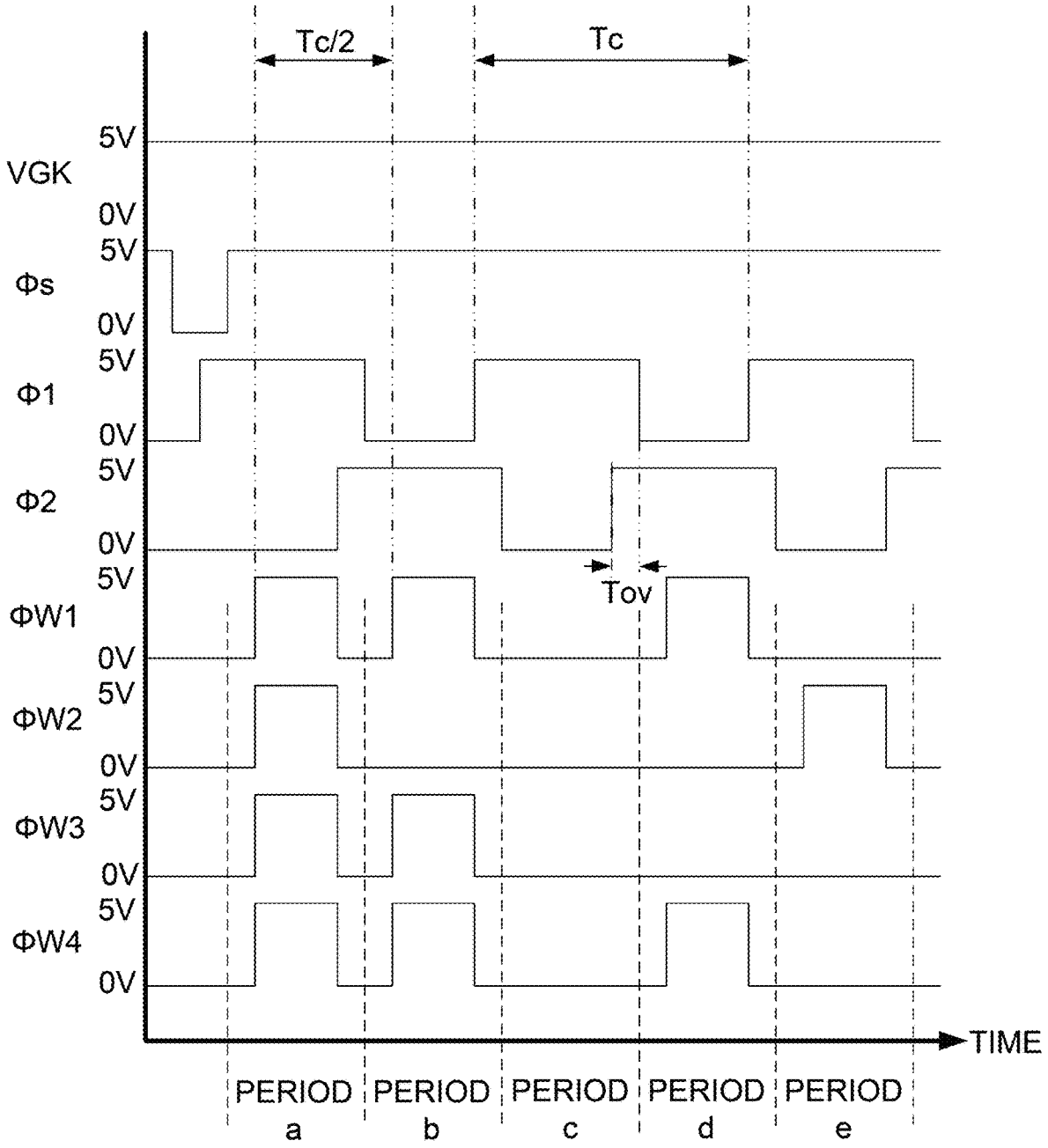

FIG. 13 is an illustration showing drive signal waveforms of the surface emitting element array chip in the embodiment.

Figure 14:
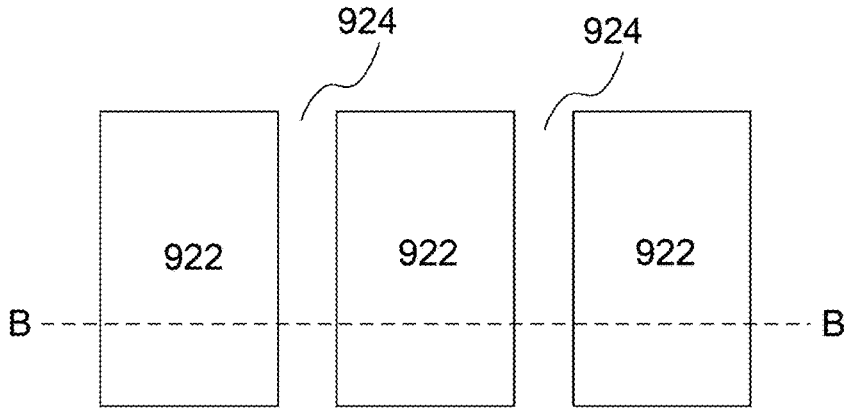
Figure 14:
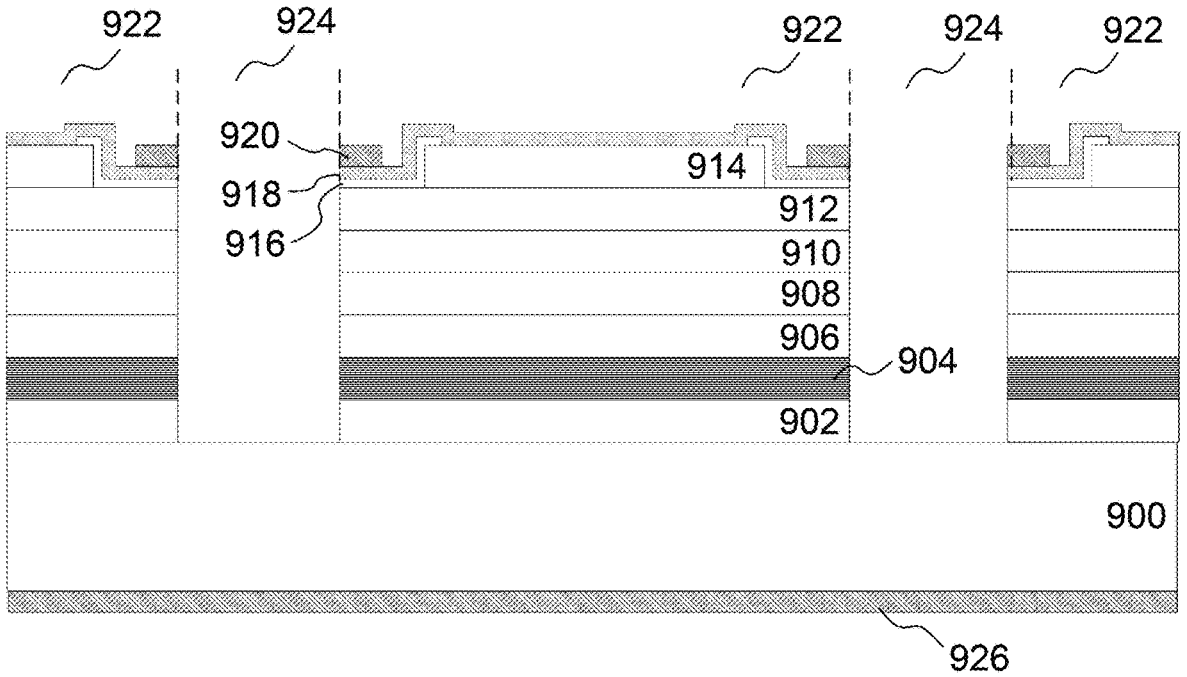

Parts (a) and (b) of FIG. 14 are a view of and a cross-sectional view of a surface emitting thyristor in the embodiment.

DESCRIPTION OF THE EMBODIMENTS

In the following, embodiments of the present invention will be described in detail with reference to the drawings.

Embodiment

[Structure of Image Forming Apparatus]

Figure 1:
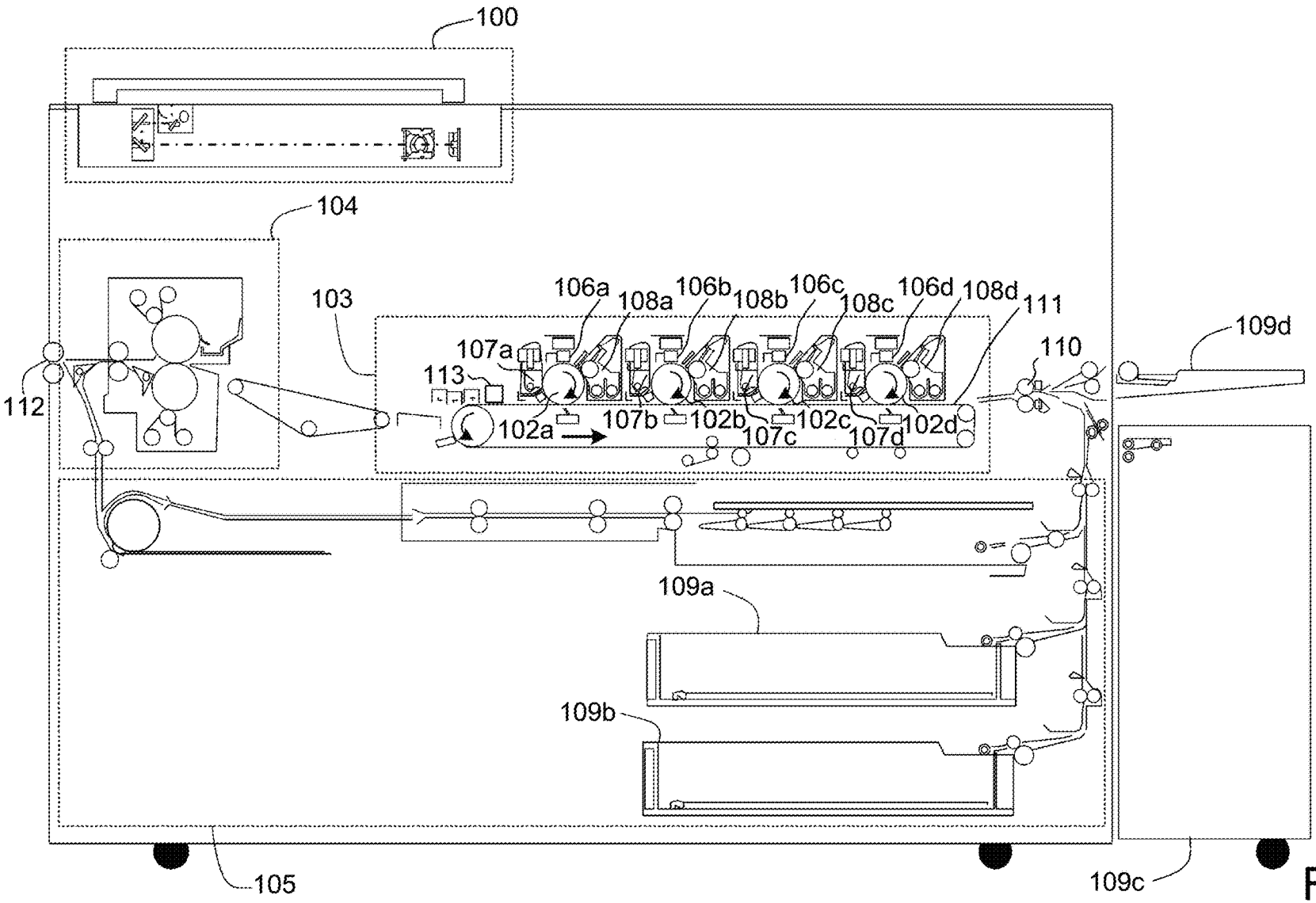
FIG. 1 is a schematic cross-sectional view illustrating a structure of an image forming apparatus according to an embodiment of the present invention.

FIG. 1 is a schematic cross-sectional view illustrating a structure of an electrophotographic image forming apparatus according to Embodiment 1. The image forming apparatus shown in FIG. 1 is a multifunction peripheral (MFP) including a scanner function and a printer function, and includes a scanner portion 100, an image forming portion 103, a fixing portion 104, the sheet feeding portion 105, and a printer controller (not shown). The scanner portion 100 illuminates an original placed on an original table, optically reads the original image, and converts the read image into an electrical signal to create image data.

The image forming portion 103 includes four image forming stations arranged along the rotational direction (counterclockwise direction) of an endless conveyance belt 111 in the order of cyan (C) image forming station, magenta (M) image forming station, yellow (Y) image forming station, and black (K) image forming station. The four image forming stations have the same structure, and each image forming station includes a photosensitive drum 102 which is a photosensitive member rotatable in a direction of an arrow (clockwise), an exposure head 106, a charging device 107, and a developing device 108. Here, the subscripts a, b, c, and d of the photosensitive drum 102, the exposure head 106, the charging device 107, and the developing portion 108 indicate that they are for black (K), yellow (Y), magenta (M), and cyan (C) image forming stations, respectively. Here, in the following, the suffixes are omitted except when referring to a specific photosensitive drum or the like.

In the image forming portion 103, the photosensitive drum 102 is driven to rotate, and the photosensitive drum 102 is charged by the charging device 107. The exposure head 106, which is the exposure means, emits light from the arrayed LED array according to the image data, and the light emitted from the chip surface of the LED array is collected on the photosensitive drum 102 (on the photosensitive member) by the rod lens array, so that an electrostatic latent image is formed. The developing device 108 develops the electrostatic latent image formed on the photosensitive drum 102 with toner. And, the developed toner image is transferred onto a recording sheet on a conveyance belt 111 which conveys the recording sheet. A series of such electrophotographic processes are executed at each image forming station. Here, during image formation, after a predetermined time has elapsed since image formation at the cyan (C) image forming station is started, image forming operations are executed sequentially at the magenta (M), yellow (Y), and black (K) image forming stations.

The image forming apparatus shown in FIG. 1 is provided with internal sheet feeding units 109*a* and 109*b* included in the sheet feeding portion 105 as units for feeding recording sheet, an external sheet feeding unit 109*c* which is a large capacity sheet feeding unit, and a manual sheet feed unit 109*d*.

During the image forming operation, recording sheet is fed from a sheet feeding portion designated in advance, and the fed recording sheet is fed to the registration roller 110. The registration roller 110 feeds the recording sheet to the feeding belt 111 at such a timing that the toner image formed in the image forming portion 103 is transferred onto the recording sheet. The toner images formed on the photosensitive drum 102 of the respective image forming stations are sequentially transferred onto the recording sheet fed by the feeding belt 111. The recording sheet on which the toner image (unfixed) has been transferred is fed to the fixing portion 104. The fixing portion 104 has a built-in heat source such as a halogen heater, and fixes the toner image on the recording sheet by heating and pressing with two rollers. The recording sheet on which the toner image is fixed by the fixing portion 104 is discharged to the outside of the image forming apparatus by the discharge roller 112.

On the downstream side of the black (K) image forming station in the recording sheet conveyance direction, an optical sensor 113 functioning as a detection portion is disposed at a position facing the conveyance belt 111. The optical sensor 113 detects the position of the test image formed on the conveyor belt 111 to determine the color misregistration amount of the toner image between each image forming station. The amount of color deviation detected by the optical sensor 113 is notified to a control board 415 (FIG. 5) which will be described hereinafter, and the image position of each color is corrected so that a full color toner image without color misregistration is transferred onto the recording sheet. In addition, in response to an instruction from the MFP controller (not shown) which controls the entire MFP (MFP), a printer controller (not shown) executes an image forming operation while controlling the above-described scanner portion 100, image forming portion 103, fixing portion 104, sheet feeding portion 105, and the like.

Here, as an example of an electrophotographic image forming apparatus, an image forming apparatus which directly transfers a toner image formed on the photosensitive drum 102 of each image forming station onto a recording sheet on the conveyance belt 111 has been described. The present invention is not limited to a printer which transfers the toner image from the photosensitive drum 102 directly onto the recording sheet. For example, the present invention can also be applied to an image forming apparatus including a primary transfer portion which transfers a toner image from the photosensitive drum 102 onto an intermediary transfer belt and a secondary transfer portion which transfers the toner image from the intermediary transfer belt onto the recording sheet.

[Structure of Exposure Head]

Next, the exposure head 106 which exposes the photosensitive drum 102 will be explained referring to parts (a) and (b) of FIG. 2. Part (a) of FIG. 2 is a perspective view illustrating a positional relationship between the exposure head 106 and the photosensitive drum 102, and part (b) of FIG. 2 is a view illustrating an internal structure of the exposure head 106 and showing how the light beam from the exposure head 106 is condensed on the photosensitive drum 102 by the rod lens array 203. As shown in part (a) of FIG. 2, the exposure head 106 is mounted to the image forming apparatus by a mounting member (not shown) at a position facing the photosensitive drum 102 rotatable in a direction of an arrow (FIG. 1).

As shown in part (b) of FIG. 2, the exposure head 106 includes a drive substrate 202, a surface-light-emitting-element array element group 201 mounted on the drive substrate 202, a rod lens array 203, and a casing 204. The rod lens array 203 and the drive substrate 202 are mounted to the casing 204. The rod lens array 203 condenses the light flux from the surface-light-emitting-element array element group 201 on the photosensitive drum 102. At the factory, the exposure head 106 is assembled and adjusted by itself, and the focus and light intensity of each spot are adjusted. Here, the assembling and adjustment is performed such that a distance between the photosensitive drum 102 and the rod lens array 203 and a distance between the rod lens array 203 and the surface-light-emitting-element array element group 201 are predetermined distances. By this, the light from the surface-light-emitting-element array element group 201 is imaged on the photosensitive drum 102. Therefore, at the time of focus adjustment at the factory, the mounting position of the rod lens array 203 is adjusted so that the distance between the rod lens array 203 and the surface-light-emitting-element array element group 201 is a predetermined value. In addition, when adjusting the light intensity at the factory, each surface light emitting element of the surface-light-emitting-element array element group 201 is caused to emit light sequentially, and the drive current of each surface light emitting element is adjusted so that the light condensed on the photosensitive drum 102 via the rod lens array 203 has a predetermined light intensity.

Part (a) of FIG. 3 is a view illustrating a light intensity distribution before adjusting the light intensity of the surface-light-emitting-element array elements constituting the surface-light-emitting-element array element group 201 of the exposure head 106. The horizontal axis of part (a) in FIG. 3 indicates the position of each surface-light-emitting-element array element (chip), and the vertical axis indicates the intensity of light emitted from the surface-light-emitting-element array element. The surface-light-emitting-element array elements vary in light quantity from chip to chip, and for example, the light quantity differs between chip 1 and chip 2 in the Figure by about 10%. If an image is formed in this state, the density difference between chips will be visible, which is undesirable. For this reason, in the factory inspection process before shipment, the difference between the adjustment target light intensity and the light emission intensity of each chip is detected, and drive voltage data Vx (x=1 to 29, individual data for surface emitting element array chips), which is the drive voltage value which provides the light output of the adjustment target value for each chip, is measured. And, the measured drive voltage data Vx is stored in a memory 420 (FIG. 5) which is a storage portion provided in the exposure head 106. In the image forming apparatus, the drive voltage data Vx (x=1 to 29) is read out of the memory 420 during image formation and set in the exposure head 106. In addition, the intensity of light required for the exposure head 106 varies depending on the conditions of the image forming apparatus, and therefore, while adjusting the light intensity of the entire exposure head 106, the light intensity variation of each chip is adjusted. Part (b) of FIG. 3 is an illustration showing an image adjustment light quantity of each surface-light-emitting-element array element when adjusted to a predetermined light quantity (factory adjustment light quantity) at the factory, and the control light intensity of each surface-light-emitting-element array element when the light intensity is controlled according to the image density during image formation. The horizontal axis of part (b) of FIG. 3 indicates the position of each surface-light-emitting-element array element (chip), and the vertical axis indicates the light emission quantity of the surface-light-emitting-element array element.

[Structure of Surface-Light-Emitting-Element Array Element Group]

Parts (a), (b) and (c) of FIG. 4 illustrate the surface-light-emitting-element array element group 201. Part (a) of FIG. 4 is a schematic illustration showing the structure of the surface on which the surface-light-emitting-element array element group 201 of the driving substrate 202 is mounted, part (b) of FIG. 4 is a schematic illustration showing the structure of the surface (second surface) opposite to the surface (first surface) on which the surface-light-emitting-element array element group 201 of the drive substrate 202 is mounted.

As shown in part (a) of FIG. 4, the surface emitting element array element group 201 mounted on the driving substrate 202 has a structure in which 29 surface emitting element array chips 1 to 29 are arranged in two rows in a staggered manner along the longitudinal direction of the driving substrate 202. Here, in part (a) of FIG. 4, the vertical direction indicates the first direction, which is the sub-scanning direction (the peripheral moving direction of rotation of the photosensitive drum 102), and the horizontal direction is the second direction perpendicular to the sub-scanning direction. Inside each surface light emitting element array chip, each element of the surface light emitting element array chip including a total of 516 light emitting points is arranged at a predetermined resolution pitch in the longitudinal direction of the surface light emitting element array chip. In each surface emitting element array in this embodiment, the pitch of each element of the surface emitting element array chip is approximately 21.16 μm (≈2.54 cm/1200 dots), which means a resolution of 1200 dpi, and which is the first resolution. As a result, the distance from end to end of 516 light emitting points in one surface light emitting element array chip is about 10.9 mm (≈21.16 μm×516). The surface-light-emitting-element array element group 201 comprises 29 surface light emitting element array chips. The number of light emitting elements which can be exposed in the surface-light-emitting-element array element group 201 is 14,964 elements (=516 elements×29 chips), and the image formation corresponding to the width in the main scanning direction of about 316 mm (≈10.9 mm×29 chips) is possible.

Part (c) of FIG. 4 is an illustration showing a state of a boundary portion between the chips of the surface emitting element array chips arranged in two rows in the longitudinal direction, the horizontal direction is the longitudinal direction of the surface-light-emitting-element array element group 201 in part (a) of FIG. 4. As shown in part (c) of FIG. 4, at the end of the surface emitting element array chip, there is provided a wire bonding pad to which a control signal is inputted, and a transfer portion and the light emitting element are driven by the signal fed from the wire bonding pad. In addition, the surface light emitting element array chip has a plurality of light emitting elements. At the boundary between the surface light emitting element array chips, the pitch of the light emitting elements in the longitudinal direction (the distance between the center point of the adjacent two light emitting elements) is approximately 21.16 μm, which is a 1200 dpi resolution pitch. In addition, the surface emitting element array chips arranged in two upper and lower rows are placed such that a light emitting point interval (indicated by an arrow S in the Figure) of the upper and lower surface emitting element array chips is approx. 84 μm (distance of integer multiple of the resolution, that is, 4 pixels at 1200 dpi, 8 pixels at 2400 dpi).

As shown in part (b) of FIG. 4, drive portions 303*a* and 303*b* and a connector 305 are mounted on the surface of the drive substrate 202 opposite to the surface on which the surface-light-emitting-element array element group 201 is provided. The drivers 303*a* and 303*b* arranged on the respective sides of the connector 305 drive the surface light emitting element array chips 1 to 15 and the surface light emitting element array chips 16 to 29, respectively. The drive portions 303*a* and 303*b* are connected to the connector 305 via patterns 304*a* and 304*b*, respectively. Connector 305 is connected to signal lines, power supply voltage, and ground for controlling drive portions 303*a* and 303*b* from control board 415 (FIG. 5), which will be described hereinafter, thus it is connected to drive portions 303*a* and 303*b*. In addition, from the drive portions 303*a* and 303*b*, a wiring for driving the surface-light-emitting-element array element group 201 passes through an inner layer of the driving substrate 202 and is connected to the surface light emitting element array chips 1 to 15 and the surface light emitting element array chips 16 to 29.

[Control Board and Drive Board Control Structure]

FIG. 5 shows a control substrate 415 which processes image data and outputs the processed data to the drive substrate 202 of the exposure head 106, and a drive substrate of the exposure head 106 which exposes the photosensitive drum 102 based on the image data inputted from the control substrate 415. As for the driving substrate 202, the surface emitting element array chips 1 to 15 controlled by the driving portion 303*a* shown in FIG. 5 will be described. Here, the surface emitting element array chips 16 to 29 controlled by the driving portion 303*b* (not shown in FIG. 5) also carry out the same operation as the surface emitting element array chips 1 to 15 controlled by the driving portion 303*a*. To simplify the explanation, the explanation will be made as to the image processing for one color here, although in the image forming apparatus of this embodiment, the same processing is carried out simultaneously in four colors. A control board 415 shown in FIG. 5 has a connector 416 for transmitting a signal for controlling the exposure head 106 to the drive board 202. From the connector 416, the image data, the line synchronization signal which will be described hereinafter, and the control signal from the CPU 400 of the control board 415 (an example of an image formation controller) are transmitted through the cables 417, 418, and 419 connected to the connector 305 of the drive board 202, respectively.

[Structure of Control Board]

In the control board 415, the CPU 400 performs image data processing and print timing processing. The control board 415 includes functional blocks of image data generation portion 401, a line data shift portion 402, a chip data conversion portion 403, a chip data shift portion 404, a data transmission portion 405, and a synchronization signal generation portion 406. In this embodiment, the image data generation portion 401 is constituted by one integrated circuit (IC). In addition, the line data shift portion 402, the chip data conversion portion 403, the chip data shift portion 404, the data transmission portion 405, and the synchronization signal generation portion 406 are constituted by another integrated circuit (IC) different from the integrated circuit including the image data generation portion 401. Here, the image data generation portion 401, the line data shift portion 402, the chip data conversion portion 403, the chip data shift portion 404, the data transmission portion 405, and the synchronization signal generation portion 406 are modules inside the integrated circuit (IC), In addition, the CPU 400 is another circuit different from these integrated circuits, and the control board 415 is mounted with the CPU 400, the integrated circuit including the image data generation portion 401, the integrated circuit including the line data shift portion 402, and the connector 416. Here, the image data generation portion 401, the line data shift portion 402, the chip data conversion portion 403, the chip data shift portion 404, the data transmission portion 405, and the synchronization signal generation portion 406 may be included in one integrated circuit. Furthermore, the image data generation portion 401, the line data shift portion 402, the chip data conversion portion 403, the chip data shift portion 404, the data transmission portion 405, the synchronization signal generation portion 406, and the CPU 400 may be included in one integrated circuit. In the following, processing in each functional block will be described in the order in which image data on the control board 415 is processed.

(Image Data Generator)

An image data generation portion 401 functioning as a generation means performs dithering processing on the image data received from the scanner portion 100 or an external computer connected to the image forming apparatus, at a resolution instructed by the CPU 400 for print output, so that the image data is generated.

(Line Data Shift Portion)

The CPU 400 determines the image shift amounts in the main scanning direction and the sub-scanning direction based on the color misregistration amount detected by the optical sensor 113, respectively. The image shift amount is determined by the CPU 400 based on, for example, the relative color misregistration amount between colors calculated based on a detection result of the color misregistration detection pattern image by the optical sensor 113. And, the CPU 400 instructs the line data shift portion 402 functioning as correction means on the image shift amount. In the line data shift portion 402, based on the image shift amount instructed by the CPU 400, the image data (also referred to as line data) inputted from the image data generation portion 401 for the entire image area for one page of recording sheet is processed for shifting. The image formation position is corrected by the shift process. Here, the line data shift portion 402 may divide the image area for one page of the recording sheet into a plurality of parts, and execute a shift process for each of the plurality of divided image areas.

(Synchronization Signal Generator)

The synchronization signal generation portion 406 generates a periodic signal for one line in the rotational direction of the photosensitive drum 102 (hereinafter referred to as "line synchronization signal") in synchronization with the rotation speed of the photosensitive drum 102. The CPU 400 instructs the synchronization signal generation portion 406 about the cycle of the line synchronization signal. The line synchronization signal cycle is a period (one line period) in which the surface of the photosensitive drum 102 moves in the rotational direction (sub-scanning direction) by the pixel size based on the resolution instructed by the CPU 400, for a predetermined rotation speed of the photosensitive drum 102. As for the speed in the sub-scanning direction, when the image forming apparatus includes a detection portion that detects the rotation speed of the photosensitive drum 102, the CPU 400 detects the photosensitive drum speed in the sub-scanning direction based on the detection result of the detection portion (the generation period of the signal output from the encoder). And, the CPU 400 determines the cycle of the line synchronization signal based on the calculation result. Here, the detector is an encoder provided on the rotating shaft of the photosensitive drum, for example. On the other hand, when the image forming apparatus is not provided with a detection portion which detects the rotation speed of the photosensitive drum 102, the rotation speed of the photosensitive drum 102 is calculated based on the following information. That is, the CPU 400 determines the cycle of the line synchronization signal based on the paper type information such as the sheet basis weight (g/cm$^2$) and the sheet size inputted on the operation portion by the user.

(Chip Data Converter)

The chip data conversion portion 403 reads line data for each line in the sub-scanning direction of the photosensitive drum 102 from the line data shift portion 402 in synchronism with the line synchronization signal. And, the chip data conversion portion 403 executes data processing for dividing the read line data into line data for each chip, and stores the data in the memories 501 to 529 corresponding to the respective surface light emitting element array chips 1 to 29.

FIG. 6 is a block diagram showing a structure of the chip data conversion portion 403. In FIG. 6, the line synchronization signal outputted from the synchronization signal generation portion 406 is inputted to the counter 530. When the line synchronization signal is inputted, the counter 530 resets the count value to 0 and then increments the counter value in synchronization with a clock signal (not shown). The chip data conversion portion 403 reads the image data for one line in the sub-scanning direction during the line synchronization signal, writes the image data to the line memory 500, and writes the image data to the memories 501 to 529. Therefore, the counter 530 performs a count operation for twice the number of pixels of one line of image data. The first half period of the count value of the counter 530 is the period Tm1, and the second half period of the count value is the period Tm2. READ controller 531 reads out image data corresponding to the count value of the counter 530 from the line data shift portion 402. That is, the READ controller 531 stores image data for one line in the sub-scanning direction in the line memory 500 when the count value of the counter 530 is the period Tm1. In addition, the WR controller 532 divides and writes the image data for one line in the sub-scanning direction stored in the line memory 500 into the memories 501 to 529 when the count value of the counter 530 is the period Tm2. Memories 501 to 529 have a smaller storage capacity than the line memory 500, and store line data (divided line data) divided for each chip. Here, the memories 501 to 529 are FIFO (First In First Out) memories provided corresponding to the surface light emitting element array chips 1 to 29. That is, the memory 501 stores line data corresponding to the surface light emitting element array chip 1, the memory 502 stores line data corresponding to the surface emitting element array chip 2, and the memory 529 stores line data corresponding to the surface light emitting element array chip 29.

In this embodiment, line data for one line in the main scanning direction is sequentially read from the line memory 500, and the writing to the memory 501 which stores the line data of the surface light emitting element array chip 1 is performed first. Next, the writing to the memory 502 which stores the image data of the surface light emitting element array chip 2 is then performed, and then the writing is sequentially performed up to the memory 529 which stores the image data of the surface light emitting element array chip 29. Here, the chip data shift portion 404 at the subsequent stage of the chip data conversion portion 403 performs data shift processing in the sub-scanning direction in the portions of surface light emitting element array chips. Therefore, the memories 501 to 529 store line data for 10 lines in the sub-scanning direction.

(Chip Data Shift Portion)

The chip data shift portion 404, which is the correction portion, performs the following control. That is, the relative readout timing of the line data from the memories 501 to 529 is controlled based on the data (2400 dpi unit) relating to the image shift amount in the sub-scanning direction for each surface emitting element array chip instructed in advance by the CPU 400. In the following, the image shift process in the sub-scanning direction executed by the chip data shift portion 404 will be specifically described.

It is preferable that there is no deviation in the mounting position of each even-numbered surface emitting element array chip in the longitudinal direction of the exposure head 106. Similarly, also in the longitudinal direction of the exposure head 106, it is preferable that there is no deviation in the mounting position of each odd-numbered surface emitting element array chip. In addition, the mounting positional relationship in the sub-scanning direction between the even-numbered surface-emitting element array chips and the odd-numbered surface-emitting element array chips corresponds preferably to a predetermined number of pixels (for example, 8 pixels) at 2400 dpi. Furthermore, it is preferable that the arrangement position of the light-emitting element array in each surface light-emitting element array chip in the sub-scanning direction is constant without individual difference. However, the mounting position of the surface light emitting element array chip and the arrangement position of the light emitting element rows involves errors, and these errors may cause a reduction in image quality of the output image.

The memory 420 (ROM) shown in FIG. 4 stores the correction data calculated from the relative positional relationship in the sub-scanning direction of each light emitting element array of the surface light emitting element array chips 1 to 29 mounted in a staggered manner on the drive substrate 202. For example, the memory 420 stores the correction data based on the following measurement data. The stored correction data is indicative of the deviation (in the unit of pixel equivalent to 2400 dpi in the sub scanning direction) of the light emitting element row of a surface light emitting element array chip 2 to 29 mounted on the drive substrate 202 from the light emitting element row of the surface light emitting element array chip 1 as a reference for the position in the sub scanning direction. After mounting the surface emitting element array chips 2 to 29 on the drive board 202, the light emitting elements of each surface light emitting element array chip are activated by the measuring device, and the measurement is performed based on the received light then. The CPU 400 sets the correction data read from the memory 420 in the internal register of the chip data shift portion 404 in response to the power supply of the image forming apparatus being turned on. The chip data shift unit 404 performs line data shift processing for forming the same line stored in the memories 501 to 529 based on the correction data set in the internal register. For example, when the light-emitting element array of the surface light-emitting element array chip 2 mounted on the drive substrate is deviated relative to the light-emitting element array of the surface light-emitting element array chip 1 by 8 pixels in the sub-scanning direction in an equivalent of 2400 dpi, the chip data shift portion 404 performs the following processing. That is, the chip data shift portion 404 delays the output timing of line data corresponding to the surface emitting element array chip 2 forming the same line by 8 pixels, with respect to the output timing of the line data corresponding to the surface emitting element array chip 1 to the driving substrate 202. Therefore, the chip data shift unit 404 shifts all line data corresponding to the surface light emitting element array chip 2 with respect to the line data corresponding to the surface emitting element array chip 1.

(Data Transmission Portion)

The data transmission unit 405 transmits the line data after performing the above-described data processing on the series of line data to the driving substrate 202 of the exposure head 106.

[Exposure Head Driver]

(Data Receiver)

Next, the processing inside the drive portion 303*a* of the exposure head 106 will be described.

The drive portion 303*a* includes functional blocks of a data reception portion 407, a PWM signal generation portion 411, a timing controller 412, a control signal generation portion 413, and a drive voltage generation portion 414. In the following, the processing of each functional block will be described in the order in which image data is processed by the drive portion 303*a*. Here, as described above, the chip data conversion portion 403 arranges image data for each of the 29 surface emitting element array chips, and the subsequent processing blocks are constituted to process each image data stored in the 29 chips in parallel. The driving portion 303*a* includes a circuit which receives image data corresponding to the surface light emitting element array chips 1 to 15 and can process each surface light emitting element array chip in parallel.

(Data Receiver)

The data receiving portion 407 receives a signal transmitted from the data transmitting portion 405 of the control board 415. Here, the data reception portion 407 and the data transmission portion 405 transmit and receive image data in the portion of lines in the sub-scanning direction in synchronization with the line synchronization signal.

(PWM Signal Generator, Timing Controller, Control Signal Generator, Drive Voltage generator)

The PWM signal generator 411 generates a pulse width signal (hereinafter referred to as the pulse width signal) provided by converting the pulse width corresponding to the light emission time performed in one pixel portion by the surface emitting element array chip in accordance with the data value for each pixel inputted from the data receiving portion 407. The timing for outputting the PWM signal is controlled by the timing controller 412. The timing controller 412 generates a synchronization signal corresponding to the pixel section of each pixel from the line synchronization signal generated by the synchronization signal generation portion 406 of the control board 415, and outputs the synchronization signal to the PWM signal generation portion 411. The drive voltage generator 414 generates a drive voltage for driving the surface emitting element array chip in synchronization with the PWM signal. Here, the drive voltage generation portion 414 has a structure in which the voltage level of the output signal can be adjusted around 5V so that the CPU 400 provides a predetermined light intensity. In this embodiment, each surface light emitting element array chip is constituted such that four light emitting elements can be driven independently from each other at the same time. The drive voltage generator 414 supplies drive signals to 4 lines of drive signal for each surface emitting element array chip, that is, for the entire exposure head 106, supplies drive signals to staggered 1 line ((15 chips)×4=60 lines). Drive signals supplied to each surface light emitting element array chip are ΦW1 to ΦW4 (FIG. 11), On the other hand, the surface light emitting element chip array is sequentially driven by the operation of a shift thyristor (FIG. 11), which will be described hereinafter. The control signal generation portion 413 generates control signals Φs, Φ1, and Φ2 for transferring the shift thyristor for each pixel from the synchronization signal corresponding to the pixel portion generated by the timing controller 412 (FIG. 11).

[Structure of Drive Voltage Generator]

FIG. 7 is a schematic illustration showing a circuit structure of the drive voltage generation portion 414. As described in the foregoing, the drive voltage generation portion 414 generates a drive voltage for driving the surface light emitting element array chips 1 to 15 in synchronization with the PWM signal output from the PWM signal generation portion 411, and supplies the drive voltage to each surface light emitting element array chip 1 to 15. As shown in FIG. 7, the drive voltage generation portion 414 includes DACs 1100 and 1101, DACs 1111 to 1125, and switch elements 1151 to 1165, which are digital/analog conversion control circuits for converting a digital signal into an analog signal. The DAC 1100 which is the second light intensity controller and the DAC 1101 which is the third light intensity controller are DACs for controlling the light intensity of the entire exposure head 106. The DACs 1100 and 1101 generate control voltages for the DACs 1111 to 1125, which are the first light quantity controllers, to supply drive voltages to the surface light emitting element array chips 1 to 25 from the inputted power supply voltage. And, the DACs 1100 and 1101 supply the generated control voltage to the DACs 1111 to 1125 which adjust the light intensity of the surface emitting element array chips 1 to 15 provided corresponding to the surface emitting element array chips 1 to 15, respectively through analog wiring 1102, 1103. In the following, the control voltage supplied from the DAC 1100 is the first voltage, and the control voltage supplied from the DAC 1101 is the second voltage. In addition, as will be described hereinafter, the magnitude relationship between the first voltage and the second voltage is the first voltage> the second voltage.

The DACs 1111 to 1125 are provided corresponding to the surface light emitting element array chips 1 to 15 and output drive voltages for causing the surface light emitting elements of the surface light emitting element array chips to emit light. Output drive voltage is generated based on the first voltage supplied from the DAC 1100, a second voltage supplied from the DAC 1101, and a setting value (first indication value) corresponding to the output drive voltage set by the CPU 400 for each DAC 1111 to 1125. As described in the foregoing, the surface light emitting element array chips 1 to 15 provide different light emission intensities even when the same drive voltage is supplied. Therefore, in each of the DACs 1111 to 1125, a setting value corresponding to the drive voltage is set from the CPU 400 by way of a communication line (not shown), In the same surface light emitting element array chip, the variation in the intensity of light for each surface light emitting element is small, and therefore, the light intensities of the surface light emitting elements in the surface light emitting element array chip are controlled by the DACs 1111 to 1125 provided for the surface light emitting element array chips 1 to 15, respectively. In addition, the output portion which outputs the drive voltages of DACs 1111 to 1125 has a voltage drive circuit (not shown) such as a voltage follower so that the output drive voltage does not fluctuate due to the current which flows when switch elements 1151 to 1165 are turned on. The generated drive voltage is supplied to each of the surface light emitting element array chips 1 to 15 by way of the switch elements 1151 to 1165. The switch elements 1151 to 1165 cause each light emitting element array chip 1 to 15 to emit simultaneously by the four light emitting elements, and therefore, each of them has four contacts, 1151*a* to 1151*d*, 1165*a* to 1165*d*. The suffixes a, b, c, and d correspond to the drive signals ΦW1 to ΦW4 supplied to the surface emitting element array chips 1 to 15, respectively. The suffixes a, b, c, and d at the end indicate that respective contacts of the switch elements 1151 to 1165 are turned on or off by the PWM signal output from the PWM signal generation portion 411. Pulse signal of drive voltage generated in accordance with the PWM signals are supplied to the surface emitting element array chips, by way of the wirings 1131*a* to 1131*d*, 1132*a* to 1132*d* . . . 1145*a* to 1145*d* connected to the contacts of the switch elements 1151 and 1152 to 1165, respectively. By such an operation, the pulse signals having the drive voltage levels controlled for the respective surface light emitting element array chips 1 to 15 are supplied to the surface light emitting element array chips 1 to 15.

[DAC Circuit Structure]

FIG. 8 is a schematic illustration showing an example of the circuit structure of the DAC of this embodiment.

The DAC of this embodiment shown in FIG. 8 is a 6-bit DAC including input portions 1200 and 1201 to which voltage is inputted, output portion 1203 to which voltage is outputted, a ladder resistor circuit 1204 having 63 voltage dividing resistors, and a selector circuit 1205 having 64 switch contacts. In the case of the above-described DACs 1111 to 1125, the first voltage is inputted to the input portion 1200, the second voltage is inputted to the input portion 1201, and the drive voltage is outputted to the switching elements 1151 to 1165 from the output portion 1203. In addition, in DACs 1100, 1101, the power supply voltage is inputted to the input portion 1200, the ground is connected to the input portion 1201, and the output portion 1203 outputs the first voltage and the second voltage.

In the ladder resistance circuit 1204 which is a resistance portion, 63 resistors having the same resistance values are connected in series. For example, in the case of DACs 1111 to 1125, the voltage between each resistor is the voltage provided by equally dividing the first voltage input from the input portion 1200 and the second voltage input from the input portion 1201 by 63 resistors. Here, the resistance value of each resistor is the same resistance value, but there may be a difference in resistance value within the tolerance range. In addition, the resistance values of all the resistors do not necessarily have to be the same, and there may be a difference in resistance values which is larger than the tolerance among the plurality of resistors, and those resistors having the same resistance value may be included. In that case, the CPU 400 selects the resistor to be used depending on the resistance value of each resistor so that the output voltage becomes the target voltage.

On the other hand, the selector circuit 1205, which is the selector section, has 64 switch contacts, as shown in FIG. 8, and in the ladder resistor circuit 1204, 64 switch contacts are connected to the respective resistance terminals in one-to-one correspondence. And, the output voltage outputted from the output portion 1203 is determined by turning on the corresponding switch contact of the selector circuit 1205 according to the instruction value (0 to 63) from the CPU 400. For example, when the instruction value "0" is inputted from the CPU 400, the switch contact closest to the input portion 1201 of the selector circuit 1205 is turned on, and when the instruction value "1" is inputted, the switch contact second-closest to the input portion 1201 is turned on. Similarly, when the instruction value "63" is inputted from the CPU 400, the switch contact closest to the input portion 1200 of the selector circuit 1205 is turned on.

The first voltage outputted from the DAC 1100, the second voltage outputted from the DAC 1101, and the output voltages (drive voltages) supplied to the surface light emitting element array chips 1 to 25 by the DACs 1111 to 1125 can be calculated by the following Equations (1)-(3).

First voltage=power supply voltage×(1st voltage setting value/63) (Equation 1)

Second voltage=Power supply voltage×(2nd voltage setting value/63) (Equation 2)

Output voltage of each surface light emitting element array chip=(first voltage−second voltage)×(DAC setting value for each surface light emitting element array chip/63)+second voltage (Equation 3)

Here, the first voltage setting value is a voltage setting value (second instruction value) corresponding to the first voltage set from the CPU 400 to the DAC 1100, and the second voltage setting value is a voltage setting value (third instruction value) corresponding to the second voltage set from the CPU 400 to the DAC 1101. In addition, the output voltage of each surface light emitting element array chip is a drive voltage outputted from the DACs 1111 to 1125 to the surface light emitting element array chips 1 to 25. The DAC set value for each surface light emitting element array chip is a set value (instruction value) corresponding to the drive voltage instructed from the CPU 400 to each of the DACs 1111 to 1125.

[Control Sequence to Determine DAC Output Voltage]

FIG. 9 is a flowchart showing a control sequence for setting the output voltages of the DACs 1100, 1101, and 1111 to 1125. The process shown in FIG. 9 is started when the image forming operation is started in the image forming apparatus of this embodiment, and is executed by the CPU 400. Here, in the factory inspection process before shipment as described above, the difference between the adjustment target light intensity and the light emission intensity of each surface light emitting element array chip is detected, and the memory 420 stores drive voltage data Vx for obtaining a light intensity output of the adjustment target value for each surface light emitting element array chip.

In step (hereinafter referred to as S) 1301, the CPU 400 reads the drive voltage data Vx (x=1 to 29) for the surface light emitting element array chips 1 to 29 from the memory 420. As described in the foregoing, the drive voltage data Vx is data indicating the drive voltage required when each of the surface light emitting element array chips 1 to 29 emits light with the predetermined target light intensity. In S1302, the CPU 400 determines, as the first voltage, the maximum value of the driving voltage data stored in the memory 420, that is, the driving voltages of the surface emitting element array chip with the lowest light quantity, among the driving voltage data of each surface light emitting element array chip 1 to 29. And, based on the power supply voltage and the determined first voltage from (Equation 1) described above, the CPU 400 calculates a first voltage setting value to be set in the DAC 1100. Here, the lower the light intensity of the surface light emitting element array chip, the higher the drive voltage is required in order to obtain the same light intensity as the other surface light emitting element array chips. In S1303, CPU 400 determines, as the second voltage, the minimum value of the driving voltage data stored in the memory 420, that is, the driving voltages of the surface emitting element array chip including the highest light quantity, among the driving voltage data of each surface light emitting element array chip 1 to 29. And, the CPU 400 calculates the second voltage setting value to be set in the DAC 1101 based on the power supply voltage and the determined second voltage from (Equation 2) described above. Here, the higher the light intensity of the surface light emitting element array chip, the lower the drive voltage is to provide the same light intensity as other surface light emitting element array chips.

In S1304, the CPU 400 calculates the DAC setting value corresponding to each surface emitting element array chip using the following Equation 4 and Equation 5, based on the first voltage, the second voltage, and the driving voltage data Vx of each surface emitting element array chip 1 to 29.

DAC resolution=(first voltage−second voltage)/63 (Equation 4)

Chip-specific DAC setting value=(Drive voltage data *Vx*−Second voltage)/DAC resolution (Equation 5)

In S1305, the CPU 400 sets the calculated first voltage setting value, second voltage setting value, and DAC setting value for each surface light emitting element array chip in the DACs 1100, 1101, and 1111 to 1125, respectively, and ends the process.

Here, when the first voltage and the second voltage are set to the same value as the driving voltage data Vx of the surface emitting element array chip at the time of factory adjustment stored in the memory 420, in the processing of S1302 and S1303, the surface light-emitting element is controlled with the same light intensity as at the factory adjustment. On the other hand, when controlling the light intensity of the entire exposure head 106 to the required light intensity (hereinafter referred to as control light intensity) according to the conditions at the time of image formation, the CPU 400 calculates the first voltage and the second voltage using the following Equation 6 and Equation 7.

First voltage=Drive voltage maximum value *V*max×Control light quantity/Factory adjustment light quantity (Equation 6)

Second voltage=drive voltage minimum value *V*min×control light quantity/factory adjustment light quantity (Equation 7)

Here, the maximum drive voltage value Vmax is the maximum voltage value of the drive voltage in the drive voltage data of the surface emitting element array chips stored in the memory 420. In addition, the minimum drive voltage value Vmin is the minimum voltage value of the drive voltage in the drive voltage data of the surface emitting element array chips stored in the memory 420. Factory-adjusted light intensity is a predetermined light intensity when adjusted in the factory inspection process before shipment.

By performing the calculations of Expression 6 and Expression 7 in the processes of S1302 and S1303, the first voltage and the second voltage in the control light intensity are determined. By this, the light intensity of the surface light emitting element array chip, which is the maximum light intensity in the exposure head 106, and the light intensity of the surface light emitting element array chip, which is the minimum light intensity, are the light intensity levels to be controlled. Here, in the structure of this embodiment, when controlling the light intensity of the entire exposure head 106, it is possible to perform light intensity control only by controlling the settings of the first voltage and the second voltage without changing the settings of the DACs 1101 to 1125, which individually adjust each surface emitting element array chip. The description will be made as to the case where the first voltage at the time of factory adjustment is 4.4V, the second voltage is 3.6V, and the drive voltage of a certain surface emitting element array chip is 4.0V, for example. In this case, the driving voltage of the corresponding surface emitting element array chip is a voltage value just between the first voltage and the second voltage, and therefore, the 6-bit DAC setting value set for each surface emitting element array chip is "32". In the case of controlling to reduce the light intensity of the entire exposure head 106, the first voltage is changed to 2.2V and the second voltage is changed to 1.8V, for example. In this case, the driving voltage of the corresponding surface light emitting element array chip is 2.0V, which is exactly the middle voltage between the first voltage (2.2V) and the second voltage (1.8V), while the DAC setting value is kept at "32". That is, the driving voltage of each surface light emitting element array chip is controlled at the relatively same ratio. Therefore, the determination of each DAC setting value in S1304 and the setting of each DAC setting value in S1305 can be omitted in the subsequent processing if they are executed in the first light intensity setting flow after the power is turned on. For example, when the intensity of light is frequently controlled due to factors such as in-machine temperature rise of the image forming apparatus, it will suffice if only the first voltage and the second voltage are determined by the processing of S1302 and S1303, and the DAC setting value is set in the DACs 1100 and 1101 by the processing of S1305. By this, while correcting the light intensity variation of the entire exposure head 106, the light intensity of the entire exposure head 106 can be controlled, and therefore, the intensity of light switching time required by the communication and the response speed of the DAC when setting the DAC set value for the surface emitting element array chips is significantly reduced.

In addition, in this embodiment, the example in which the intensity of light is controlled by controlling the voltage level to be applied in the driving method in which the surface light emitting element array chip is voltage driven has been described. As for the drive system which controls the light intensity by current drive, the intensity of light can be adjusted by controlling the surface emitting element array chips individually, if the current source is constituted so that the drive current value is determined in accordance with the output voltage of the DAC1100, 1101. Here, in the case of a surface light emitting element array chip where the light intensity of the surface light emitting element array chip is not proportional to the driving voltage or driving current (for example, light is emitted when the driving voltage is 2V or more, and the light intensity increases linearly from 2V to 5V), the light intensity can be controlled by performing the following arithmetic processing. That is, the voltage V0 (2V in this case) when the light intensity becomes zero is stored in the memory 420 in advance, and the above Equation 6 and Equation 7 are changed to the following Equation 8 and Equation 9, by which the light intensity can be controlled with higher accuracy.

First voltage=(maximum drive voltage-max $V0$)×(control light quantity)/(factory adjustment light quantity)+voltage $V0$ Equation 8

Second voltage=(maximum drive voltage-min $V0$)×control light quantity/factory adjustment light quantity+voltage $V0$ Equation 9

[Example of DAC circuit structure]

As for the circuit structure of the DAC, a 6-bit DAC structure using the ladder resistor circuit 1204 and the selector circuit 1205 has been described as an example, but the number of bits may be determined according to the required accuracy, and it is not necessary to have 6 bits. In addition, other types of DAC which do not use the ladder resistor circuit 1204 and the selector circuit 1205 may be used. Parts (a) and (b) of FIG. 10 are schematic illustrations showing the circuit structure of a DAC using a PWM method. Part (a) of FIG. 10 is a circuit illustration showing an example of a circuit structure of a DAC applicable to the DACs 1100 and 1101 which control the first voltage and the second voltage described above. In part (a) of FIG. 10, the PWM signal generated by the PWM generator 1401 (corresponding to the second instruction value and the third instruction value) is inputted to the gate terminal of the FET 1402 which is the switch portion. FET 1402 performs the switching operation in accordance with the duty of the PWM signal. When the FET 1402 is in the on-state, the power supply voltage is inputted to the smoothing circuit 1403, which is a smoothing portion comprising a resistor and a capacitor, by way of the FET 1402, so that the input power supply voltage is smoothed by the smoothing circuit 1403. And, the smoothed voltage is outputted through a wiring 1405 (corresponding to the analog wirings 1102 and 1103 in FIG. 7) by a voltage follower 1404 which is an output portion. In the circuit structure shown in part (a) of FIG. 10, an analog voltage corresponding to the on-state ratio of the PWM signal is outputted with respect to the power supply voltage. Part (b) of FIG. 10 is a circuit illustration showing an example of a circuit structure of a DAC applicable to the DACs 1111 to 1125 which individually adjust the driving voltages of the surface light emitting element array chips 1 to 29. In part (b) of FIG. 10, the first voltage is inputted from the input portion 1416 and the second voltage is inputted from the input portion 1417. The PWM signal (corresponding to the third instruction value) generated by the PWM generator 1411 is inputted to the gate terminal of the FET 1412 which is a switching element. FET 1412 performs a switching operation in accordance with the duty of the PWM signal. The smoothing circuit 1413 comprising the resistor and the capacitor smoothes the first voltage inputted when the FET 1412 is on and the second voltage inputted when the FET 1412 is off. And, the smoothed voltage is outputted via a wiring 1415 by a voltage follower 1414 which is an output portion. As described above, also in the PWM method, the light intensity control of the entire exposure head 106 and the light intensity control of the surface emitting element array chip can be performed as in the method using the ladder resistor described above.

[Sled Circuit]

FIG. 11 is an equivalent circuit in which a part of the self-scanning LED (SLED) chip array of this embodiment is extracted. In FIG. 11, Ra and Rg are anode resistance and gate resistance respectively, Tn is a shift thyristor, Dn is a transfer diode, and Ln is a light emitting thyristor. In addition, Gn depicts a common gate of the corresponding shift thyristor Tn and the light emitting thyristor Ln connected to the shift thyristor Tn. Here, n is an integer of 2 or more. Φ1 is a transfer line of an odd-numbered shift thyristor T, and Φ2 is a transfer line of an even-numbered shift thyristor T. ΦW1 to ΦW4 are lighting signal lines for the light-emitting thyristor L, and are connected to resistors RW1 to RW4, respectively. VGK is a gate line, and Φs is a start pulse line. As shown in FIG. 11, four light emitting thyristors L4*n*−3 to L4*n* are connected to one shift thyristor Tn, and the four light emitting thyristors L4*n*−3 to L4*n* can be turned on simultaneously.

[Operation of SLED Circuit]

The operation of the SLED circuit shown in FIG. 11 will be described. Here, in the circuit illustration of FIG. 11, it is assumed that 5V is applied to the gate line VGK, and the voltages inputted to the transfer lines Φ1, Φ2 and the lighting signal lines ΦW1 to ΦW4 are also 5V. In FIG. 11, when the shift thyristor Tn is on, the potential of the common gate Gn of the light-emitting thyristor Ln connected to the shift thyristor Tn and the shift thyristor Tn is lowered to about 0.2V. The common gate Gn of the light emitting thyristor Ln and the common gate Gn+1 of the light emitting thyristor Ln+1 are connected by a coupling diode Dn, and therefore, a potential difference substantially equal to the diffusion potential of the coupling diode Dn is generated. In this embodiment, the diffusion potential of the coupling diode Dn is about 1.5V, and therefore, the potential of the common gate Gn+1 of the light emitting thyristor Ln+1 is 1.7V (=0.2V+1.5V) obtained by add in g adding 1.5V of the diffusion potential to 0.2V of the potential of the common gate Gn of the light emitting thyristor Ln. Similarly, the potential of the common gate Gn+2 of the light emitting thyristor Ln+2 is 3.2V (=1.7V+1.5V), and the potential of the common gate Gn+3 (not shown) of the light emitting thyristor Ln+3 (not shown) is 4.7V (=3.2V+1.5V) However, the potential after the common gate Gn+4 of the light-emitting thyristor Ln+4 is 5V because the voltage of the gate line VGK is not higher than this, and therefore, it is 5V. In addition, as to the potential of the common gate Gn-1 before the common gate Gn of the light emitting thyristor Ln (left side of the common gate Gn in FIG. 11), the coupling diode Dn-1 is reverse biased, and therefore, the voltage of the gate line VGK is applied as it is, and it is 5V.

Part (a) of FIG. 12 is an illustration showing the distribution of the gate potential of the common gate Gn of each light-emitting thyristor Ln when the above-described shift thyristor Tn is in the on state, in which the common gates Gn-1, Gn, Gn+1, and so on depict the common gates of the light emitting thyristors L in FIG. 11. In addition, the vertical axis of part (a) in FIG. 12 indicates the gate potential. The voltage required to turn on each shift thyristor Tn (hereinafter referred to as the threshold voltage) is substantially the same as the gate potential of the common gate Gn of each light-emitting thyristor Ln plus the diffusion potential (1.5V). When the shift thyristor Tn is on, the shift thyristor Tn+2 has the lowest gate potential of the common gate among the shift thyristors connected to the transfer line 12 of the same shift thyristor Tn. The potential of the common gate Gn+2 of the light emitting thyristor Ln+2 connected to the shift thyristor Tn+2 is 3.2V (=1.7V+1.5V) (part (a) of FIG. 12) as described above. Therefore, the threshold voltage of the shift thyristor Tn+2 is 4.7V (=3.2V+1.5V), However, shift thyristor Tn is on, and therefore, the potential of transfer line 12 is drawn to about 1.5V (diffusion potential), and it is lower than the threshold voltage of shift thyristor Tn+2, so that shift thyristor Tn+2 cannot be turned on. Other shift thyristors connected to the same transfer line 12 have a higher threshold voltage than the shift thyristor Tn+2, and therefore, it cannot be turned on, either, and only the shift thyristor Tn can be kept on.

In addition, for shift thyristors connected to transfer line Φ1, the threshold voltage of the shift thyristor Tn+1 where the threshold voltage is the lowest is 3.2V (=1.7V+1.5V). Next, the shift thyristor Tn+3 (not shown in FIG. 11) having the lowest threshold voltage is 6.2V (=4.7V+1.5V). In this state, when 5V is inputted to the transfer line Φ1, only the shift thyristor Tn+1 can be turned on. In this state, the shift thyristor Tn and the shift thyristor Tn+1 are in the on-state simultaneously. Therefore, gate potentials of shift thyristors Tn+2, Tn+3, and so on provided on the right side of the shift thyristor Tn+1 in the circuit shown in FIG. 11 are lowered by the amount corresponding to the diffusion potential (1.5V), However, the voltage of the gate line VGK is 5V, and the common gate voltage of the light emitting thyristor L is limited by the voltage of the gate line VGK, and therefore, the gate potential on the right side of the shift thyristor Tn+5 is 5V. Part (b) of FIG. 12 shows the gate voltage distribution of each of the common gates Gn-1 to Gn+4 at this time, in which the vertical axis represents the gate potential. In this state, when the potential of the transfer line Φ2 is lowered to 0V, the shift thyristor Tn is turned off, and the potential of the common gate Gn of the shift thyristor Tn is increased to the VGK potential. Part (c) of FIG. 12 is an illustration showing the gate voltage distribution at this time, in which the vertical axis shows the gate potential. In this manner, the on-state transfer from the shift thyristor Tn to the shift thyristor Tn+1 is completed.

[Light Emission Operation of Light Emitting Thyristor]

Next, a light emitting operation of the light emitting thyristor will be described. When only the shift thyristor Tn is on, the gates of the four light emitting thyristors L4*n*-3 to L4*n* are connected in common to the common gate Gn of the shift thyristor Tn. Therefore, the gate potentials of the light emitting thyristors L4*n*-3 to L4*n* are 0.2V, which is the same as that of the common gate Gn. Therefore, the threshold value of each light emitting thyristor is 1.7V (=0.2V+1.5V), and if a voltage of 1.7V or more is inputted from the lighting signal lines ΦW1 to ΦW4 of the light emitting thyristors, the light emitting thyristors L4*n*-3 to L4*n* can be turned on. Therefore, by inputting a lighting signal to the lighting signal lines ΦW1 to ΦW4 when the shift thyristor Tn is on, the four light emitting thyristors L4*n*-3 to L4*n* can selectively emit light. At this time, the potential of the common gate Gn+1 of the shift thyristor Tn+1 next to the shift thyristor Tn is 1.7V, and the threshold voltage of the light emitting thyristors L4*n*+1 to 4n+4 connected to the common gate Gn+1 is 3.2V (=1.7V+1.5V), The lighting signal inputted from lighting signal lines ΦW1 to ΦW4 is 5V, and therefore, the light-emitting thyristors L4*n*+1 to L4*n*+4 are likely to light up with the same lighting pattern as the light-emitting thyristors L4*n*-3 to 4*n*. However, the threshold voltage is lower in the light emitting thyristors L4*n*-3 to L4*n*, and therefore, when a lighting signal is inputted through the lighting signal lines ΦW1 to ΦW4, they turn on earlier than light-emitting thyristors L4*n*+1 to L4*n*+4. Once the light emitting thyristors L4*n*-3 to L4*n* are turned on, the connected lighting signal lines ΦW1 to ΦW4 are lowered to about 1.5V (diffusion potential), Therefore, the potential of the lighting signal lines ΦW1 to ΦW4 becomes lower than the threshold voltage of the light emitting thyristors L4*n*+1 to L4*n*+4, and therefore, the light emitting thyristors L4*n*+1 to L4*n*+4 cannot be turned on. As described above, by connecting the multiple light-emitting thyristors L to one shift thyristor T, the plurality of light-emitting thyristors L can be turned on simultaneously.

FIG. 13 is a timing chart of the drive signals for the SLED circuit shown in FIG. 11. FIG. 13 shows the voltage waveforms of the drive signals for the gate line VGK, the start pulse line Φs, the odd-numbered and even-numbered shift thyristor transfer lines Φ1, Φ2, and the light-emitting thyristor lighting signal lines ΦW1-ΦW4, in this order from top to bottom. Here, each drive signal has an on-state voltage of 5V and an off-state voltage of 0V. In addition, the horizontal axis in FIG. 13 indicates time. In addition, Tc indicates the period of the clock signal Φ1, and Tc/2 indicates a period that is half (=½) of the period Tc.

The voltage of 5V is always applied to the gate line VGK. In addition, the clock signal Φ1 for the odd-numbered shift thyristor and the clock signal Φ2 for the even-numbered shift thyristor are inputted at the same period Tc, and 5V is supplied as the signal Φs for the start pulse line. To make a potential difference on the gate line VGK shortly before the clock signal Φ1 for the odd-numbered shift thyristor first becomes 5V, the signal Φs on the start pulse line is dropped to 0V. By this, the gate potential of the first shift thyristor Tn−1 is lowered from 5V to 1.7V, so that the threshold voltage becomes 3.2V, and therefore it can be turned on by a signal from the transfer line Φ1. Voltage 5V is applied to the transfer line Φ1, and 5V is supplied to the start pulse line Φs, slightly after the first shift thyristor Tn−1 is turned on, and thereafter, 5V is continuously supplied to the start pulse line Φs.

The structure is such that the transfer line Φ1 and the transfer line Φ2 have a time period Tov where the ON states (5V in this case) overlap each other, and are in a substantially complementary relationship. The light-emitting thyristor lighting signal lines ΦW1 to ΦW4 are transmitted in half the cycle of the transfer lines Φ1 and Φ2, and the thyristor lights up when 5V is applied under the condition that the corresponding shift thyristor is on. For example, in the period a, all four light emitting thyristors connected to the same shift thyristor are turned on, and in the period b, the three light emitting thyristors are turned on simultaneously. In addition, in the period c, all the light emitting thyristors are turned off, and in the period d, the two light emitting thyristors are turned on simultaneously. In the period e, only one light-emitting thyristor is turned on.

In this embodiment, the number of light emitting thyristors connected to one shift thyristor is four, but it is not limited to this example, and may be less or more than four depending on the situation. Here, in the circuit described above, the cathode of each thyristor is shared, but an anode common circuit can be used by appropriately inverting the polarity.

[Structure of Surface-Emitting Thyristor]

Parts (a) and (b) of FIG. 14 illustrate the surface-emitting thyristor portion of this embodiment. Part (a) of FIG. 14 is a plan view (schematic illustration) of a light-emitting element array in which a plurality of light-emitting elements formed in a mesa (trapezoidal) structure 922 are arranged. Part (b) of FIG. 14 is a schematic cross-sectional view of the light-emitting element formed in the mesa structure 922 taken along a line BB shown in part (a) of FIG. 14. The mesa structures 922 in which the light emitting element is formed are arranged at a predetermined pitch (interval between adjacent light emitting elements) (for example, approximately 21.16 μm in the case of 1200 dpi resolution), and they are separated from each other by grooves 924.

In part (b) of FIG. 14, reference numeral 900 depicts a compound semiconductor substrate of the first conductivity type: 902 is a buffer layer of the same first conductivity type as the substrate 900; and 904 is a distributed Bragg reflection (DBR) layer comprising a stack of two types of semiconductor layers of the first conductivity type. In addition, reference numeral 906 depicts a first conductivity type semiconductor layer; 908 is a first second-conductivity-type semiconductor layer different from the first conductivity type; 910 is a second first-conductivity type semiconductor layer; and 912 is a second second-conductivity-type semiconductor layer. As shown in part (b) of FIG. 14, a pnpn type (or npnp type) thyristor structure is formed by alternately laminating semiconductors having different conductivity types of the semiconductor layers 906, 908, 910, and 912. In this embodiment, the substrate 900 is an n-type GaAs substrate, the buffer layer 902 is an n-type GaAs layer or an n-type AlGaAs layer, and the DBR layer 904 is a laminated structure of an n-type high Al composition AlGaAs layer and a low Al composition layer. The n-type AlGaAs is used for the first first-conductivity-type semiconductor layer 906 on the DBR layer, and p-type AlGaAs is used for the first second-conductivity-type semiconductor layer 908. In addition, the second first-conductivity-type semiconductor layer 910 uses n-type AlGaAs, and the second second-conductivity-type semiconductor layer 912 uses p-type AlGaAs.

In addition, in the mesa structure type surface emitting device, the light emission efficiency is improved by using a current confinement mechanism to prevent the current from flowing to the side surface of the mesa structure 922. Here, the current confinement mechanism in this embodiment will be described. As shown in part (b) of FIG. 14, in this embodiment, a p-type GaP layer 914 is formed on a p-type AlGaAs which is the second second-conductivity-type semiconductor layer 912, and an ITO layer 918 which is an n-type transparent conductor is further formed thereon. The p-type GaP layer 914 is formed with a sufficiently high impurity concentration in the portion in contact with the ITO layer 918 of the transparent conductor. When a forward bias is applied to the light emitting thyristor (for example, when the back electrode 926 is grounded and a positive voltage is applied to the front electrode 920), a tunnel junction is established because the p-type GaP layer 914 is formed with a sufficiently high impurity concentration in the portion in contact with the ITO layer 918 of the transparent conductor. As a result, the current flows. With such a structure, the p-type GaP layer 914 concentrates the current on the portion of the n-type transparent conductor in contact with the ITO layer 918 to form a current confinement mechanism. Here, in this embodiment, an interlayer of insulating layer 916 is provided between the ITO layer 918 and the p-type AlGaAs layer 912. However, the mounted diode formed by the n-type ITO layer 918 and the p-type AlGaAs layer 912 is reverse-biased with respect to the forward bias of the light-emitting thyristor, and therefore, when the forward-bias is applied, basically no current flows other than at the tunnel junction. Therefore, it can be omitted, if the reverse diode withstand voltage of the mounted diode formed by the n-type ITO layer 918 and the p-type AlGaAs layer 912 is sufficient for the required usage. With this structure, the light is emitted by the semiconductor lamination portion under the portion substantially equivalent to the portion where the p-type GaP layer 914 and the n-type transparent conductor ITO layer 918 are in contact, and the DBR layer 904 reflects most of the emitted light to the opposite side of the substrate 900.

In the exposure head 106 in this embodiment, the density of light emitting points (interval between light emitting elements) is determined depending on the resolution. The surface light emitting elements inside the surface light emitting element array chip are separated into mesa structures 922 by element separating grooves 924, and, when forming an image with a resolution of 1200 dpi, for example, the distance between the element centers of adjacent light emitting elements (light emitting points) is arranged to be 21.16 μm.

As described above, based on the driving voltage of the surface light emitting element array chip with the maximum and minimum light quantity among the surface light emitting element array chips, two reference voltages (first voltage, second voltage) are determined, and the DAC of each surface emitting element array chip is driven based on the reference voltage. By this, it is possible to reduce the circuit scale of the DAC while accurately correcting variations in the amount of light emitted from each surface light emitting element array chip. For example, even when the variation of the light emitting element array chip is ±16% (the variation width (range) is 32%), the correction can be made with a resolution of 0.5% (=32%/64) by using a 6-bit (64-step) DAC. Furthermore, by performing the light amount control of the entire exposure head with a common DAC 1100, 1101, it becomes possible to prevent the occurrence of density difference between the surface light emitting element array chips, without reducing the control resolution of the DAC for each surface emitting element array chip. When controlling the light amount of the entire exposure head, there is no need to reset the DAC settings for individual surface emitting element array chips, and therefore, the amount of light can be switched in a short time, and the amount of light can be switched without reducing the productivity of the entire image forming apparatus.

Here, in this embodiment, the exposure head in which the surface light emitting element array chips are arranged has been described as an example. The present invention is similarly effective for a laser scanning type exposure means comprising a plurality of light emitting elements. In particular, in the exposure means using VCSEL (surface emitting laser) with a large number of beams, the same effect can be achieved by grouping them on the basis of the output optical power and by using two reference voltages which are common to the group and a DAC for each light emitting element.

As has been described in the foregoing, according to this embodiment, it is possible to suppress an increase in circuit scale and to control the variation in the amount of light for each semiconductor chip with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-211159 filed on Nov. 9, 2018, which is hereby incorporated by reference herein in its entirety.

What is claimed is:

1. An image forming apparatus comprising:

a photosensitive member;

an exposure head including a plurality of light emitting elements for exposing said photosensitive member; and an image formation controller configured to control said exposure head to form an image in accordance with image data, wherein said exposure head includes:

a plurality of array chips each including said plurality of light emitting elements, and an output portion configured to output a driving voltage for driving said plurality of light emitting elements to said array chips, wherein said output portion includes:

a first voltage controller provided corresponding to each of said array chips and configured to output the driving voltage, a second voltage controller configured to output a maximum voltage of set voltages individually set corresponding to each of said array chips to said first voltage controller, and a third voltage controller configured to output a minimum voltage of the set voltages individually set corresponding to each of said array chips to said first voltage controller, wherein said first voltage controller includes:

a resistance portion including a plurality of resistors, and switches which are provided corresponding to each of said plurality of resistors and each of which is turned on or off in accordance with an instruction from said image formation controller to divide an input voltage by said resistance portion, and wherein said image formation controller controls each of said switches in accordance with the image data so that said output portion outputs, to each of said plurality of array chips, a voltage between the maximum voltage and the minimum voltage on the basis of the maximum voltage outputted from said second voltage controller and the minimum voltage outputted from said third voltage controller.

2. An image forming apparatus according to claim 1, wherein said second voltage controller includes a resistance portion including a plurality of resistors and switches provided corresponding to each of said plurality of resistors and configured to turn on or off in accordance with an instruction from said image formation controller and to divide an inputted reference voltage by said resistance portion, and wherein said third voltage controller includes a resistance portion including a plurality of resistors and switches provided corresponding to each of said plurality of resistors, and configured to turn on or off in accordance with an instruction from said image formation controller to divide an inputted reference voltage by said resistance portion.

3. An image forming apparatus according to claim 2, wherein a resistance of said resistance portion of said first voltage controller, a resistance of said resistance portion of said second voltage controller, and a resistance of said resistance portion of said third voltage controller are the same.

4. An image forming apparatus according to claim 3, wherein said print head includes a storing portion, said storing portion storing a driving voltage to be supplied to each of said array chips corresponding to each of said array chips as the set voltage, when said light emitting elements included in said array chips emit light with a predetermined light amount, wherein when starting image formation, said image formation controller connects only the switch corresponding to the maximum drive voltage of the drive voltages stored in said storing portion among the switches of said second voltage controller to output the maximum voltage from said second voltage controller to said first voltage controller, and connects only the switch corresponding to the minimum drive voltage of the drive voltages stored in said storing portion among said switches of said third voltage controller to output the minimum voltage from said third voltage controller to said first voltage controller.

5. An image forming apparatus according to claim 1, wherein said print head includes a storing portion, said storing portion storing a driving voltage to be supplied to each of said array chips corresponding to each of said array chips as the set voltage, when said light emitting elements included in said array chips emit light with a predetermined light amount.

* * * * *